US012256803B2

(12) United States Patent
Trudel et al.

(10) Patent No.: US 12,256,803 B2
(45) Date of Patent: Mar. 25, 2025

(54) REEL BASED CLOSURE DEVICES FOR TIGHTENING A SKI BOOT

(71) Applicant: Boa Technology Inc., Denver, CO (US)

(72) Inventors: Thomas Andrew Trudel, Denver, CO (US); Charles Corbett, Denver, CO (US); Josef Duller, Louisville, CO (US); Ilya Minkin, Denver, CO (US); Bobby Dickensheets, Denver, CO (US); Stefan Sporrer, Mondsee (AT); Alessandro Manzato, Mondsee (AT); Eric Irwin, Denver, CO (US)

(73) Assignee: Boa Technology Inc., Denver, CO (US)

( * ) Notice: Subject to any disclaimer, the term of this patent is extended or adjusted under 35 U.S.C. 154(b) by 0 days.

(21) Appl. No.: 16/778,830

(22) Filed: Jan. 31, 2020

(65) Prior Publication Data

US 2020/0245711 A1 Aug. 6, 2020

Related U.S. Application Data

(60) Provisional application No. 62/800,222, filed on Feb. 1, 2019.

(51) Int. Cl.

| | |
|---|---|
| ***A43B 1/00*** | (2006.01) |
| ***A43B 5/04*** | (2006.01) |
| ***A43C 1/00*** | (2006.01) |

(52) U.S. Cl.

CPC ..... *A43B 5/0429* (2013.01); *A43B 5/0447* (2013.01); *A43C 1/003* (2013.01)

(58) Field of Classification Search

CPC ... A43B 5/0429; A43B 5/0433; A43B 5/0435; A43B 5/0437; A43B 5/0443;

(Continued)

(56) References Cited

U.S. PATENT DOCUMENTS

| | | | |
|---|---|---|---|
| 59,332 | A | 10/1866 | White et al. |
| 80,834 | A | 8/1868 | Prussia |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

U.S. Appl. No. 09/956,601 Including its prosecution history, filed Sep. 18, 2001, Hammerslag.

(Continued)

*Primary Examiner* — Sharon M Prange

(74) *Attorney, Agent, or Firm* — Kilpatrick Townsend & Stockton LLP

(57) ABSTRACT

A differentially tightenable ski boot includes a lower shell and an upper cuff that is pivotally coupled with the lower shell. The ski boot includes a first tightening system that is coupled with the lower shell and a second tightening system that is coupled with the upper cuff. Each tightening system includes a reel based closure device, a tension member that is operably coupled with the reel based closure device, and at least one guide member that routes or directs the tension member along a path about the lower shell or upper cuff. The first tightening system and the second tightening system are operable independently of each other to independently and differentially tightening the lower shell and the upper cuff.

18 Claims, 14 Drawing Sheets

(58) Field of Classification Search
CPC ..... A43B 5/0447; A43B 5/045; A43C 1/003; A43C 7/08; A43C 11/165
USPC ..... 36/50.5
See application file for complete search history.

(56) References Cited

U.S. PATENT DOCUMENTS

| | | | |
|---|---|---|---|
| 117,530 | A | 8/1871 | Foote |
| 228,946 | A | 6/1880 | Schulz |
| 230,759 | A | 8/1880 | Drummond |
| 379,113 | A | 3/1888 | Hibberd |
| 568,056 | A | 9/1896 | Vail, Jr. |
| 746,563 | A | 12/1903 | McMahon |
| 819,993 | A | 5/1906 | W. E. Haws et al. |
| 908,704 | A | 1/1909 | Sprinkle |
| 1,060,422 | A | 4/1913 | Bowdish |
| 1,062,511 | A | 5/1913 | Short |
| 1,083,775 | A | 1/1914 | Thomas |
| 1,090,438 | A | 3/1914 | Worth et al. |
| 1,170,472 | A | 2/1916 | Barber |
| 1,288,859 | A | 12/1918 | Feller et al. |
| 1,390,991 | A | 9/1921 | Fotchuk |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,429,657 | A | 9/1922 | Trawinski |
| 1,481,903 | A | 4/1923 | Hart |
| 1,466,673 | A | 9/1923 | Solomon et al. |
| 1,530,713 | A | 2/1924 | Clark |
| 1,502,919 | A | 7/1924 | Seib |
| 1,862,047 | A | 6/1932 | Boulet et al. |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,907,086 | A | 10/1959 | Ord |
| 2,926,406 | A | 3/1960 | Zahnor |
| 2,991,523 | A | 7/1961 | Del Conte |
| 3,028,602 | A | 4/1962 | Miller |
| 3,035,319 | A | 5/1962 | Wolff |
| 3,106,003 | A | 10/1963 | Herdman |
| 3,112,545 | A | 12/1963 | Williams |
| 3,122,810 | A | 3/1964 | Lawrence et al. |
| 3,163,900 | A | 1/1965 | Martin |
| D200,394 | S | 2/1965 | Hakim |
| 3,169,325 | A | 2/1965 | Fesl |
| 3,193,950 | A | 7/1965 | Liou |
| 3,197,155 | A | 7/1965 | Chow |
| 3,214,809 | A | 11/1965 | Zahnor |
| 3,221,384 | A | 12/1965 | Aufenacker |
| 3,276,090 | A | 10/1966 | Nigon |
| D206,146 | S | 11/1966 | Hendershot |
| 3,345,707 | A | 10/1967 | Rita |
| D210,649 | S | 4/1968 | Getgay |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,934,346 | A | 1/1976 | Sasaki et al. |
| 3,975,838 | A | 8/1976 | Martin |
| 4,084,267 | A | 4/1978 | Zadina |
| 4,095,354 | A | 6/1978 | Annovi |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,408,403 | A | 10/1983 | Martin |
| 4,417,703 | A | 11/1983 | Weinhold |
| 4,433,456 | A | 2/1984 | Baggio |
| 4,433,679 | A | 2/1984 | Mauldin et al. |
| 4,452,405 | A | 6/1984 | Adomeit |
| 4,463,761 | A | 8/1984 | Pols et al. |
| 4,480,395 | A | 11/1984 | Schoch |
| 4,507,878 | A | 4/1985 | Semouha |
| 4,516,576 | A | 5/1985 | Kirchner |
| 4,551,932 | A | 11/1985 | Schoch |
| 4,555,830 | A | 12/1985 | Petrini et al. |
| 4,574,500 | A | 3/1986 | Aldinio et al. |
| 4,616,432 | A | 10/1986 | Bunch et al. |
| 4,616,524 | A | 10/1986 | Biodia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,644,938 | A | 2/1987 | Yates et al. |
| 4,653,204 | A | 3/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,862,878 | A | 9/1989 | Davison |
| 4,870,723 | A | 10/1989 | Pozzobon et al. |
| 4,870,761 | A | 10/1989 | Tracy |
| 4,884,760 | A | 12/1989 | Baggio et al. |
| 4,901,938 | A | 2/1990 | Cantley et al. |
| 4,924,605 | A | 5/1990 | Spademan |
| D308,282 | S | 6/1990 | Bergman et al. |
| 4,937,953 | A | 7/1990 | Walkhoff |
| 4,961,544 | A | 10/1990 | Biodia |
| 4,979,953 | A | 12/1990 | Spence |
| 4,989,805 | A | 2/1991 | Burke |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | DeBortoli |
| 5,065,481 | A | 11/1991 | Walkhoff |
| 5,108,216 | A | 4/1992 | Geyer et al. |
| 5,117,567 | A | 6/1992 | Berger |
| 5,129,130 | A | 7/1992 | Lecouturier |
| 5,136,794 | A * | 8/1992 | Stampacchia ..... A43B 5/0474 36/118.7 |
| 5,152,038 | A | 10/1992 | Schoch |
| 5,157,813 | A | 10/1992 | Carroll |
| 5,158,428 | A | 10/1992 | Gessner et al. |
| 5,167,612 | A | 12/1992 | Bonutti |
| 5,177,882 | A | 1/1993 | Berger |
| 5,178,137 | A | 1/1993 | Goor et al. |
| 5,181,331 | A | 1/1993 | Berger |
| 5,184,378 | A | 2/1993 | Batra |
| D333,552 | S | 3/1993 | Berger et al. |
| 5,205,055 | A | 4/1993 | Harrell |

(56) References Cited

U.S. PATENT DOCUMENTS 5,213,094 A 5/1993 Bonutti
5,233,767 A 8/1993 Kramer
5,249,377 A 10/1993 Walkhoff
5,259,094 A 11/1993 Zepeda
5,315,741 A 5/1994 Debberke
5,319,868 A 6/1994 Hallenbeck
5,319,869 A 6/1994 McDonald et al.
5,325,613 A 7/1994 Sussmann
5,327,662 A 7/1994 Hallenbeck
5,335,401 A 8/1994 Hanson
5,341,583 A 8/1994 Hallenbeck
5,345,697 A 9/1994 Quellais
5,346,461 A 9/1994 Heinz et al.
5,355,596 A 10/1994 Sussmann
5,357,654 A 10/1994 Hsing-Chi
5,365,947 A 11/1994 Bonutti
5,371,957 A 12/1994 Gaudio
5,381,609 A 1/1995 Hieblinger
5,392,535 A 2/1995 Van Noy et al.
5,395,304 A 3/1995 Tarr et al.
D357,576 S 4/1995 Steinweis
5,425,161 A 6/1995 Schoch
5,425,185 A 6/1995 Gansler
5,430,960 A 7/1995 Richardson
5,433,648 A 7/1995 Frydman
5,437,617 A 8/1995 Heinz et al.
5,456,268 A 10/1995 Bonutti
5,463,822 A 11/1995 Miller
5,477,593 A 12/1995 Leick
D367,755 S 3/1996 Jones
D367,954 S 3/1996 Dion
5,502,902 A 4/1996 Sussmann
5,511,325 A 4/1996 Hieblinger
5,526,585 A 6/1996 Brown et al.
5,535,531 A 7/1996 Karabed et al.
5,537,763 A 7/1996 Donnadieu et al.
5,557,864 A 9/1996 Marks
5,566,474 A 10/1996 Leick et al.
D375,831 S 11/1996 Perry
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
5,607,448 A 3/1997 Stahl et al.
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,685,830 A 11/1997 Bonutti
5,692,319 A 12/1997 Parker et al.
5,718,021 A 2/1998 Tatum
5,718,065 A 2/1998 Locker
5,720,084 A 2/1998 Chen
5,732,483 A 3/1998 Cagliari
5,732,648 A 3/1998 Aragon
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,068 A 8/1998 Bernier et al.
5,819,378 A 10/1998 Doyle
5,833,640 A 11/1998 Vazquez, Jr. et al.
5,839,210 A 11/1998 Bernier et al.
5,845,371 A 12/1998 Chen
5,891,061 A 4/1999 Kaiser
5,909,946 A 6/1999 Okajima
D413,197 S 8/1999 Faye
5,934,599 A 8/1999 Hammerslag
5,937,542 A 8/1999 Bourdeau
5,956,823 A 9/1999 Borel
5,971,946 A 10/1999 Quinn et al.
6,015,110 A 1/2000 Lai
6,032,387 A 3/2000 Johnson
6,038,791 A 3/2000 Cornelius et al.
6,052,921 A 4/2000 Oreck
6,070,886 A 6/2000 Cornelius et al.
6,070,887 A 6/2000 Cornelius et al.
6,083,857 A 7/2000 Bottger
6,088,936 A 7/2000 Bahl
6,102,412 A 8/2000 Staffaroni
D430,724 S 9/2000 Matis et al.
6,119,318 A 9/2000 Maurer
6,119,372 A 9/2000 Okajima
6,128,835 A 10/2000 Ritter et al.
6,128,836 A 10/2000 Barret
6,148,489 A 11/2000 Dickie et al.
6,202,953 B1 3/2001 Hammerslag
6,219,891 B1 4/2001 Maurer et al.
6,240,657 B1 6/2001 Weber et al.
6,256,798 B1 7/2001 Egolf et al.
6,267,390 B1 7/2001 Maravetz et al.
6,286,233 B1 9/2001 Gaither
6,289,558 B1 9/2001 Hammerslag
6,311,633 B1 11/2001 Keire
D456,130 S 4/2002 Towns
6,370,743 B2 4/2002 Choe
6,401,364 B1 6/2002 Burt
6,416,074 B1 7/2002 Maravetz et al.
6,464,657 B1 10/2002 Castillo
6,467,195 B2 10/2002 Pierre et al.
6,477,793 B1 11/2002 Pruitt et al.
6,502,286 B1 1/2003 Dubberke
6,543,159 B1 4/2003 Carpenter et al.
6,568,103 B2 5/2003 Durocher
6,606,804 B2 8/2003 Kaneko et al.
6,685,662 B1 2/2004 Curry et al.
6,689,080 B2 2/2004 Castillo
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,792,702 B2 9/2004 Borsoi et al.
6,793,641 B2 9/2004 Freeman et al.
6,796,951 B2 9/2004 Freeman et al.
6,802,439 B2 10/2004 Azam et al.
6,823,610 B1 11/2004 Ashley
6,871,812 B1 3/2005 Chang
6,877,256 B2 4/2005 Martin et al.
6,899,720 B1 5/2005 McMillan
6,922,917 B2 8/2005 Kerns et al.
6,938,913 B2 9/2005 Elkington
6,942,632 B2 9/2005 Cho
6,945,543 B2 9/2005 De Bortoli et al.
D510,183 S 10/2005 Tresser
6,962,571 B2 11/2005 Castillo
6,976,972 B2 12/2005 Bradshaw
6,993,859 B2 2/2006 Martin et al.
D521,226 S 5/2006 Douglas et al.
7,073,279 B2 7/2006 Min
7,076,843 B2 7/2006 Sakabayashi
7,082,701 B2 8/2006 Dalgaard et al.
7,096,559 B2 8/2006 Johnson et al.
7,134,224 B2 11/2006 Elkington et al.
7,182,740 B1 2/2007 Castillo
7,198,610 B2 4/2007 Ingimundarson et al.
7,266,911 B2 9/2007 Holzer et al.
7,281,341 B2 * 10/2007 Reagan ..... A43B 3/0031 36/50.1
7,293,373 B2 11/2007 Reagan et al.
7,314,458 B2 1/2008 Bodenschatz
7,331,126 B2 2/2008 Johnson
7,343,701 B2 3/2008 Pare et al.
7,367,522 B2 5/2008 Chen
7,386,947 B2 6/2008 Martin et al.
7,392,602 B2 7/2008 Reagan et al.
7,401,423 B2 7/2008 Reagan et al.

(56) References Cited

U.S. PATENT DOCUMENTS 7,402,147 B1 7/2008 Allen
7,490,458 B2 2/2009 Ford
7,516,914 B2 4/2009 Kovacevich
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,618,386 B2 11/2009 Nordt, III et al.
7,618,389 B2 11/2009 Nordt, III et al.
7,624,517 B2 12/2009 Smith
7,648,404 B1 1/2010 Martin
7,650,705 B2 1/2010 Donnadieu et al.
7,662,122 B2 2/2010 Sterling
7,694,354 B2 4/2010 Philpott et al.
7,704,219 B2 4/2010 Nordt, III et al.
7,713,225 B2 5/2010 Ingimundarson et al.
7,752,774 B2 7/2010 Ussher
7,757,412 B2 7/2010 Farys
7,774,956 B2 8/2010 Dua et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
D626,322 S 11/2010 Servettaz
7,841,106 B2 11/2010 Farys
7,871,334 B2 1/2011 Young et al.
7,877,845 B2 2/2011 Signori
7,878,998 B2 2/2011 Nordt, III et al.
7,887,500 B2 2/2011 Nordt, III et al.
7,896,827 B2 3/2011 Ingimundarson et al.
7,900,378 B1 3/2011 Busse
7,908,769 B2 3/2011 Pellegrini
7,922,680 B2 4/2011 Nordt, III et al.
7,935,068 B2 5/2011 Einarsson
7,947,005 B2 5/2011 Castillo
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
7,993,296 B2 8/2011 Nordt, III et al.
8,016,781 B2 9/2011 Ingimundarson et al.
D646,790 S 10/2011 Castillo et al.
8,056,150 B2 11/2011 Stokes et al.
8,061,061 B1 11/2011 Rivas
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
D663,850 S 7/2012 Joseph
D663,851 S 7/2012 Joseph
8,215,033 B2 7/2012 Carboy et al.
8,231,074 B2 7/2012 Hu et al.
8,231,560 B2 7/2012 Ingimundarson et al.
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,353,088 B2 1/2013 Ha
8,381,362 B2 2/2013 Hammerslag et al.
D677,045 S 3/2013 Voskuil
D679,019 S 3/2013 Siddle et al.
8,434,200 B2 5/2013 Chen
8,468,657 B2 6/2013 Soderberg et al.
8,490,299 B2 7/2013 Dua et al.
8,516,662 B2 8/2013 Goodman et al.
8,578,632 B2 11/2013 Bell et al.
8,652,164 B1 2/2014 Aston
8,713,820 B2 5/2014 Kerns et al.
8,984,719 B2 3/2015 Soderberg et al.
9,072,341 B2 7/2015 Jungkind
D735,987 S 8/2015 Hsu
9,101,181 B2 8/2015 Soderberg et al.
9,125,455 B2 9/2015 Kerns et al.
9,138,030 B2 9/2015 Soderberg et al.
9,259,056 B2 2/2016 Soderberg et al.
10,123,589 B2 11/2018 Soderberg et al.
10,383,403 B2 * 8/2019 Modena ..... A43B 5/0476
10,602,804 B2 * 3/2020 Modena ..... A43C 1/003
2002/0050076 A1 5/2002 Borsoi et al.
2002/0052568 A1 5/2002 Houser et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0041478 A1 3/2003 Liu
2003/0051374 A1 3/2003 Freed
2003/0079376 A1 5/2003 Oorei et al.
2003/0144620 A1 7/2003 Sieller
2003/0150135 A1 8/2003 Liu
2003/0177662 A1 9/2003 Elkington et al.
2003/0204938 A1 11/2003 Hammerslag
2004/0041452 A1 3/2004 Williams
2004/0159017 A1 8/2004 Martin
2004/0211039 A1 10/2004 Livingston
2005/0054962 A1 3/2005 Bradshaw
2005/0060912 A1 3/2005 Holzer et al.
2005/0081339 A1 4/2005 Sakabayashi
2005/0081403 A1 4/2005 Mathieu et al.
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0178872 A1 8/2005 Hyun
2005/0184186 A1 8/2005 Tsoi et al.
2005/0198866 A1 9/2005 Wiper et al.
2005/0273025 A1 12/2005 Houser
2006/0135901 A1 6/2006 Ingimundarson et al.
2006/0156517 A1 7/2006 Hammerslag et al.
2006/0179685 A1 8/2006 Borel et al.
2006/0185193 A1 8/2006 Pellegrini
2006/0287627 A1 12/2006 Johnson
2007/0006489 A1 1/2007 Case et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0169378 A1 7/2007 Sodeberg et al.
2007/0276306 A1 11/2007 Castillo
2008/0016717 A1 1/2008 Ruban
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0068204 A1 3/2008 Carmen et al.
2008/0083135 A1 4/2008 Hammerslag et al.
2008/0092279 A1 4/2008 Chiang
2008/0172848 A1 7/2008 Chen
2008/0196224 A1 8/2008 Hu
2009/0019734 A1 1/2009 Reagan et al.
2009/0071041 A1 3/2009 Hooper
2009/0090029 A1 4/2009 Kishino
2009/0099562 A1 4/2009 Ingimudarson et al.
2009/0124948 A1 5/2009 Ingimundarson et al.
2009/0172928 A1 7/2009 Messmer et al.
2009/0184189 A1 7/2009 Soderberg et al.
2009/0272007 A1 11/2009 Beers et al.
2009/0277043 A1 11/2009 Graser et al.
2009/0287128 A1 11/2009 Ingimundarson et al.

(56) References Cited

U.S. PATENT DOCUMENTS

2010/0064547 A1 3/2010 Kaplan et al.
2010/0081979 A1 4/2010 Ingimundarson et al.
2010/0094189 A1 4/2010 Ingimundarson et al.
2010/0101061 A1 4/2010 Ha
2010/0139057 A1 6/2010 Soderberg et al.
2010/0154254 A1 6/2010 Fletcher
2010/0174221 A1 7/2010 Ingimundarson et al.
2010/0175163 A1 7/2010 Litke
2010/0217169 A1 8/2010 Ingimundarson
2010/0251524 A1 10/2010 Chen
2010/0299959 A1 12/2010 Hammerslag et al.
2010/0319216 A1 12/2010 Grenzke et al.
2010/0331750 A1 12/2010 Ingimundarson
2011/0000173 A1 1/2011 Lander
2011/0004135 A1 1/2011 Kausek
2011/0030244 A1* 2/2011 Motawi ..... A43C 7/00 36/117.1
2011/0071647 A1 3/2011 Mahon
2011/0098618 A1 4/2011 Fleming
2011/0099843 A1 5/2011 Jung
2011/0144554 A1 6/2011 Weaver Ll et al.
2011/0162236 A1 7/2011 Voskuil et al.
2011/0167543 A1 7/2011 Kovacevich et al.
2011/0178448 A1 7/2011 Einarsson
2011/0184326 A1 7/2011 Ingimundarson et al.
2011/0191992 A1 8/2011 Chen
2011/0197362 A1 8/2011 Chella et al.
2011/0218471 A1 9/2011 Ingimundarson et al.
2011/0225843 A1 9/2011 Kerns et al.
2011/0258876 A1 10/2011 Baker et al.
2011/0266384 A1 11/2011 Goodman et al.
2011/0288461 A1 11/2011 Arnould et al.
2011/0301521 A1 12/2011 Weissenbock et al.
2011/0306911 A1 12/2011 Tran
2012/0000091 A1 1/2012 Cotterman et al.
2012/0004587 A1 1/2012 Nickel et al.
2012/0005995 A1 1/2012 Emery
2012/0010547 A1 1/2012 Hinds
2012/0023717 A1 2/2012 Chen
2012/0029404 A1 2/2012 Weaver et al.
2012/0047620 A1 3/2012 Ellis et al.
2012/0101417 A1 4/2012 Joseph
2012/0102783 A1 5/2012 Swigart et al.
2012/0138882 A1 6/2012 Moore et al.
2012/0157902 A1 6/2012 Castillo et al.
2012/0167290 A1 7/2012 Kovacevich et al.
2012/0174437 A1 7/2012 Heard
2012/0228419 A1 9/2012 Chen
2012/0246974 A1 10/2012 Hammerslag et al.
2012/0310273 A1 12/2012 Thorpe
2013/0012856 A1 1/2013 Hammerslag et al.
2013/0014359 A1 1/2013 Chen
2013/0019501 A1 1/2013 Gerber
2013/0025100 A1 1/2013 Ha
2013/0091667 A1 4/2013 Zerfas et al.
2013/0091674 A1 4/2013 Chen
2013/0092780 A1 4/2013 Soderberg et al.
2013/0205622 A1* 8/2013 Harald ..... A43B 5/0401 36/117.1
2013/0239303 A1 9/2013 Cotterman et al.
2013/0269219 A1 10/2013 Burns et al.
2013/0277485 A1 10/2013 Soderberg et al.
2013/0340283 A1 12/2013 Bell et al.
2013/0345612 A1 12/2013 Bannister et al.
2014/0082963 A1 3/2014 Beers
2014/0094728 A1 4/2014 Soderberg et al.
2014/0117140 A1 5/2014 Goodman et al.
2014/0123440 A1 5/2014 Capra et al.
2014/0123449 A1 5/2014 Soderberg et al.
2014/0208550 A1 7/2014 Neiley
2014/0221889 A1 8/2014 Burns et al.
2014/0257156 A1 9/2014 Capra et al.
2014/0290016 A1 10/2014 Lovett et al.
2014/0359981 A1 12/2014 Cotterman et al.
2015/0007422 A1 1/2015 Cavanagh et al.
2015/0014463 A1 1/2015 Converse et al.
2015/0026936 A1 1/2015 Kerns et al.
2015/0033519 A1 2/2015 Hammerslag et al.
2015/0059206 A1* 3/2015 Lovett ..... A43C 11/004 12/142 R
2015/0076272 A1 3/2015 Trudel et al.
2015/0089779 A1 4/2015 Lawrence et al.
2015/0089835 A1 4/2015 Hammerslag et al.
2015/0101160 A1 4/2015 Soderberg et al.
2015/0150705 A1 6/2015 Capra et al.
2015/0151070 A1 6/2015 Capra et al.
2015/0190262 A1 7/2015 Capra et al.
2015/0223608 A1 8/2015 Capra et al.
2015/0237962 A1 8/2015 Soderberg et al.
2015/0335458 A1 11/2015 Romo
2015/0342302 A1* 12/2015 Hahnenberger ..... A43C 11/165 24/68 SK
2015/0359296 A1* 12/2015 Gulla ..... A43C 7/005 36/109
2017/0105489 A1* 4/2017 Lovett ..... A43C 11/20
2017/0202297 A1* 7/2017 Parisotto ..... A43C 11/165
2017/0208892 A1 7/2017 Neiley

FOREIGN PATENT DOCUMENTS

AT 517092 B1 * 11/2016 ..... A43B 23/027
AT 517582 B1 * 3/2017 ..... A43B 5/04
CA 2112789 8/1994
CA 2114387 8/1994
CH 41765 9/1907
CH 111341 11/1925
CH 199766 9/1938
CH 204 834 A 5/1939
CH 562 015 5/1975
CH 577 282 7/1976
CH 612 076 7/1979
CH 537 164 7/1981
CH 624 0001 7/1981
CH 471 553 12/1984
CN 2613167 4/2004
CN 201015448 2/2008
DE 555211 7/1932
DE 641976 2/1937
DE 1 661 668 8/1953
DE 7045778.2 3/1971
DE 1 785 220 5/1971
DE 2 062 795 6/1972
DE 7047038 1/1974
DE 23 41 658 3/1974
DE 24 14 439 10/1975
DE 29 00 077 A1 7/1980
DE 29 14 280 A1 10/1980
DE 31 01 952 A1 9/1982
DE 81 01 488.0 7/1984
DE 38 13 470 11/1989
DE 3822113 C2 1/1990
DE 9005496 U1 12/1991
DE 43 02 401 A1 8/1994
DE 43 05 671 A1 9/1994
DE 94 13 147 U 10/1994
DE 9308037 10/1994
DE 43 26 049 A1 2/1995
DE 9315776 2/1995
DE 29503552.8 4/1995
DE 196 24 553 1/1998
DE 19945045 A1 3/2001
DE 201 16 755 1/2002
DE 20 2010 000 354 U1 6/2010
DE 11 2013 005 273 T5 9/2015
EP 0 056 953 8/1982
EP 0 099 504 2/1984
EP 0 123 050 10/1984
EP 0 155 596 9/1985
EP 0 201 051 11/1986
EP 0 255 869 2/1988
EP 0297342 1/1989
EP 0 393 380 10/1990
EP 0 589 232 A1 3/1994
EP 0 589 233 A1 3/1994

(56) References Cited

FOREIGN PATENT DOCUMENTS

| | | | | |
|---|---|---|---|---|
| EP | 0 614 624 | | 9/1994 | |
| EP | 0 614 625 | A1 | 9/1994 | |
| EP | 0 651 954 | A1 | 5/1995 | |
| EP | 0 679 346 | | 11/1995 | |
| EP | 0 693 260 | B1 | 1/1996 | |
| EP | 0 734 662 | A1 | 10/1996 | |
| EP | 0 848 917 | | 6/1998 | |
| EP | 0 923 965 | | 6/1999 | |
| EP | 0 937 467 | | 8/1999 | |
| EP | 1163860 | | 12/2001 | |
| EP | 1 219 195 | | 7/2002 | |
| EP | 1 236 412 | A | 9/2002 | |
| EP | 2052636 | A1 | 4/2009 | |
| EP | 2298107 | B1 | 3/2011 | |
| EP | 2359708 | | 8/2011 | |
| EP | 3266327 | | 1/2018 | |
| EP | 3725175 | A1 * | 10/2020 | ..... A43B 5/0447 |
| EP | 3847919 | A1 * | 7/2021 | ..... A43B 5/0409 |
| FR | 1 349 832 | | 1/1964 | |
| FR | 1 374 110 | | 10/1964 | |
| FR | 1 404 799 | | 7/1965 | |
| FR | 2 019 991 | A | 7/1970 | |
| FR | 2 108 428 | | 5/1972 | |
| FR | 2 173 451 | | 10/1973 | |
| FR | 2 175 684 | | 10/1973 | |
| FR | 2 399 811 | | 3/1979 | |
| FR | 2 565 795 | | 12/1985 | |
| FR | 2 598 292 | A1 | 11/1987 | |
| FR | 2 726 440 | | 5/1996 | |
| FR | 2 726 440 | A1 | 5/1996 | |
| FR | 2 770 379 | A1 | 5/1999 | |
| FR | 2 814 919 | A1 | 4/2002 | |
| GB | 189911673 | | 7/1899 | |
| GB | 216400 | | 5/1924 | |
| GB | 2 449 722 | A | 12/2008 | |
| IT | 1220811 | | 6/1990 | |
| JP | 7-000208 | | 6/1933 | |
| JP | 8-9202 | | 6/1933 | |
| JP | 49-28618 | | 3/1974 | |
| JP | 51-2776 | | 1/1976 | |
| JP | 51-121375 | | 10/1976 | |
| JP | 51-131978 | | 10/1976 | |
| JP | 53-124987 | | 3/1977 | |
| JP | 54-108125 | | 2/1978 | |
| JP | 62-57346 | | 4/1987 | |
| JP | 63-80736 | | 5/1988 | |
| JP | H02-236025 | | 9/1990 | |
| JP | 6-284906 | | 2/1996 | |
| JP | 08-308608 | A | 11/1996 | |
| JP | 3030988 | | 11/1996 | |
| JP | 3031760 | | 12/1996 | |
| JP | 10-199366 | | 7/1998 | |
| JP | 2004-016732 | | 1/2004 | |
| JP | 2004-041666 | | 2/2004 | |
| JP | 2009-504210 | | 2/2009 | |
| KR | 20-0367882 | | 11/2004 | |
| KR | 20-0400568 | | 8/2005 | |
| KR | 10-0598627 | | 7/2006 | |
| KR | 10-0953398 | | 4/2010 | |
| KR | 101025134 | B | 3/2011 | |
| KR | 10-1028468 | | 4/2011 | |
| KR | 10-1053551 | | 7/2011 | |
| KR | 20150105341 | A | 9/2015 | |
| WO | 94/27456 | | 12/1994 | |
| WO | 95/11602 | | 5/1995 | |
| WO | 1995/03720 | | 9/1995 | |
| WO | 98/33408 | | 8/1998 | |
| WO | 98/37782 | | 9/1998 | |
| WO | 99/09850 | | 3/1999 | |
| WO | 99/15043 | | 4/1999 | |
| WO | 99/43231 | | 9/1999 | |
| WO | 00/53045 | | 9/2000 | |
| WO | 2000/76337 | A1 | 12/2000 | |
| WO | 01/08525 | | 2/2001 | |
| WO | 01/15559 | | 3/2001 | |
| WO | 02/051511 | | 7/2002 | |
| WO | 2004/093569 | | 11/2004 | |
| WO | 2005/013748 | A1 | 2/2005 | |
| WO | 2007/016983 | | 2/2007 | |
| WO | 2008/015214 | | 2/2008 | |
| WO | 2008/033963 | | 3/2008 | |
| WO | 2009/134858 | | 11/2009 | |
| WO | 2010/059989 | A2 | 5/2010 | |
| WO | 2012/165803 | A2 | 12/2012 | |
| WO | 2015/035885 | | 3/2015 | |
| WO | 2015/179332 | A1 | 11/2015 | |
| WO | 2015/181928 | A1 | 12/2015 | |

OTHER PUBLICATIONS

PCT/US2020/016130 , "International Search Report and Written Opinion", Apr. 14, 2020, 11 pages.

ASOLO® Boot Brochure Catalog upon information and belief date is as early as Aug. 22, 1997, 12 pages.

La Sportiva, A Technical Lightweight Double Boot for Cold Environments, 1 page. Accessed on May 27, 2015. Retrieved from http://www.sportiva.com/products/footwear/mountain/spantik.

"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.

International Search Report and Written Opinion for PCT/US2013/032326 mailed Jun. 14, 2013, 27 pages.

International Preliminary Report on Patentability for PCT/US2013/032326 issued Sep. 16, 2014, 6 pages.

International Search Report and Written Opinion for PCT/US2013/057637 mailed Apr. 7, 2014, 34 pages.

International Preliminary Report on Patentability for PCT/US2013/057637 issued Mar. 3, 2015, 9 pages.

International Search Report and Written Opinion for PCT/US2013/068342 mailed Apr. 7, 2014, 29 pages.

International Preliminary Report on Patentability for PCT/US2013/068342 issued May 5, 2015, 9 pages.

International Search Report and Written Opinion for PCT/US2014/014952 mailed Apr. 25, 2014, 17 pages.

International Preliminary Report on Patentability for PCT/US2014/014952 issued Aug. 11, 2015, 9 pages.

International Search Report and Written Opinion for PCT/US2014/066212 mailed Apr. 22, 2015, 16 pages.

International Search Report and Written Opinion for PCT/US2014/032574 mailed Oct. 31, 2014, 19 pages.

International Search Report and Written Opinion for PCT/US2014/045291 mailed Nov. 6, 2014, 12 pages.

International Search Report and Written Opinion for PCT/US2014/013458 mailed May 19, 2014, 12 pages.

International Preliminary Report on Patentability for PCT/US2014/013458 issued Jul. 28, 2015, 7 pages.

International Search Report and Written Opinion for PCT/US2013/068814 mailed Jun. 9, 2014, 18 pages.

International Preliminary Report on Patentability for PCT/US2013/068814 issued May 12, 2015, 12 pages.

Notice of Reasons for Rejection from the Japanese Patent Office dated Feb. 26, 2015 for design application No. 2014-015570, 4 pages.

International Search Report and Written Opinion for PCT/US2014/055710 mailed Jul. 6, 2015, 19 pages.

International Search Report and Written Opinion for PCT/US2014/054420 mailed Jul. 6, 2015, 21 pages.

The Preliminary Rejections from the Korean Intellectual Property Office for Application No. 30-2014-34959, is not translated into English. The document requests a renaming of the application to be in accordance with Korean patent law, 5 pages total.

The Preliminary Rejections from the Korean Intellectual Property Office for Application No. 30-2014-34959, is not translated into English. The document requests a revision of the drawings to be in accordance with Korean patent law, 6 pages total.

(56) References Cited

OTHER PUBLICATIONS

Certificate of Design Registration No. 30-809409 on Aug. 3, 2015 from the Korean Intellectual Property Office for Appln No. 30-2015-11475, 2 pages.
Certificate of Design Registration No. 30-809410 on Aug. 3, 2015 from the Korean Intellectual Property Office for Appln No. 30-2015-11476, 2 pages.
European Search Report for EP 14168875 mailed Oct. 29, 2014, 9 pages.
International Search Report and Written Opinion for PCT/US2014/020894 mailed Jun. 20, 2014, 12 pages.
International Preliminary Report on Patentability for PCT/US2014/020894 issued Sep. 8, 2015, 7 pages.
International Search Report and Written Opinion for PCT/US2014/041144 mailed Dec. 10, 2014, 13 pages.
International Preliminary Report on Patentability for PCT/US2014/032574 issued Oct. 6, 2015, 12 pages.
International Search Report and Written Opinion for PCT/US2014/046238 mailed Nov. 21, 2014, 17 pages.
Office Action received Oct. 8, 2015 from the German Patent and Trademark Office for Appln No. 402015100191.2, regarding the title of the invention, 2 pages.
Anonymous, "Shore durometer," Wikipedia, the free encyclopedia, Mar. 10, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.
Notice of Reasons for Rejection from the Japanese Patent Office dated Oct. 5, 2015 for design application No. 2015-004923, 4 pages.
"Save Tourniquet," 3 pages. Copyright 2015. Accessed on Dec. 11, 2015. Retrieved from http://www.savetourniquet.com/.
International Preliminary Report on Patentability for PCT/US2014/041144 issued Dec. 8, 2015, all pages.
Supplementary European Search Report for EP 13761841 dated Oct. 21, 2015, all pages.
Notice of Reasons for Rejection for Japanese Patent Application No. 2016-518004 dispatched Jan. 27, 2017, 9 pages.
Extended European Search Report for EP 20749190.3 mailed Sep. 7, 2022, all pages.

* cited by examiner

REEL BASED CLOSURE DEVICES FOR TIGHTENING A SKI BOOT

CROSS-REFERENCE TO RELATED APPLICATIONS

This application claims priority to Provisional U.S. Patent Application No. 62/800,222 filed Feb. 1, 2019, entitled "Reel Based Closure Devices for Tightening a Ski Boot", the entire disclosure of both of the aforementioned Provisional U.S. Patent Applications are hereby incorporated by reference, for all purposes, as if fully set forth herein.

BACKGROUND

Snow skiing, including alpine skiing, nordic skiing and telemark skiing, is a popular winter recreational activity or sport around the world. Equipment that is used in skiing includes boots, skis and bindings that attach the boots to the skis. Ski boots, such as alpine ski boots, typically have exterior shells that are made of rigid materials, such as various rigid polymers. The exterior shells are often difficult to close about a user's leg and foot due to the rigid polymer materials that are employed. It is also often difficult to make the ski boot comfortable due to the rigid materials that are employed. A proper balance between comfort and fit is desired in ski boots, but may be difficult to achieve due the use of rigid materials and other design constraints. Conventional closure devices that are employed to close ski boots often tighten the ski boot in relatively large increments or steps, which may add a degree of complexity in achieving a proper balance between fit and comfort.

BRIEF DESCRIPTION

The embodiments herein describe are directed to various configurations of ski boots. According to a first aspect, the ski boot may include multiple tightening systems that are configured to tighten different portions of the ski boot. For example, the ski boot may include a rigid exterior shell having a lower shell that is configured to couple with a ski binding and an upper cuff that is pivotally coupled with the lower shell. The lower shell may be configured to accommodate a foot and the upper cuff may be configured to accommodate a lower leg. A first tightening system may be coupled with the lower shell and a second tightening system may be coupled with the upper cuff. The first tightening system may include a first reel based closure device and a first tension member that is operably coupled with the first reel based closure device so that an operation of the first reel based closure device effects tightening of the first tension member. The first tightening system may also include a plurality of first guide members that are positioned about the lower shell to route or direct the first tension member along a path about the lower shell. The second tightening system may include a second reel based closure device and a second tension member that is operably coupled with the second reel based closure device so that an operation of the second reel based closure device effects tightening of the second tension member. The second tightening system may also include a plurality of second guide members that are positioned about the upper cuff to route or direct the second tension member along a path about the upper cuff. The first tightening system and the second tightening system may be operable independently of each other so as to independently and differentially tightening the lower shell and the upper cuff.

The plurality of first guide members and/or the plurality of second guide members may include a guide member that allows the respective tension member to be uncoupled from the lower shell and/or upper cuff to enable rapid loosening of a tension in the respective tension member. In some embodiments, the guide member may include an open channel within which the respective tension member is positioned. The open channel may be configured so the respective tension member is removable from the open channel to uncouple the tension member from the lower shell and/or upper cuff.

In other embodiments, the guide member may include a base member that is fixedly secured to the lower shell and/or upper cuff and a guide body that is removably attachable to the base member to couple the guide body with the lower shell and/or upper cuff. The guide body may have a channel through which the tension member is slidably positioned. A proximal end of the guide body may have a shape that corresponds to a shape of a channel of the base member, which enables mating engagement of the proximal end of the guide body within the base member's channel. The guide body may include a strap or handle that is graspable by a user to facilitate in detaching the guide body from the base member. The guide body may include four openings through which the tension member is inserted. The guide body may also include a first lace channel and a second lace channel through which the tension member is routed. The first lace channel may be separate from the second lace channel. In some embodiments, the plurality of first guide members or the plurality of second guide members may include a pair of guide members, in which each guide member has a base member and guide body as described in this paragraph.

In some embodiments, the ski boot may include a third tightening system that is coupled with a liner of the ski boot. The third tightening system may be configured to effect tightening of the ski boot liner. The third tightening system may include a third reel based closure device and a third tension member that is operably coupled with the third reel based closure device so that an operation of the third reel based closure device effects tightening of the third tension member. The third tightening system may also include a plurality of third guide members that are positioned about the liner to route or direct the third tension member along a path about the liner. The third reel based closure device may be operable independently of the first reel based closure device and the second reel based closure device to independently and differentially tightening the liner.

In some embodiments, the plurality of first guide members and/or the plurality of second guide members include one or more guides that are attached to a strap or panel that extends over an opening of the lower shell and/or upper cuff. In such embodiments, tensioning of the first tension member and/or the second tension member may pull the strap or panel over the opening of the lower shell and/or upper cuff to constrict the foot or lower leg within the lower shell and/or upper cuff. In some embodiments, at least a portion of the first tension member and/or the second tension member may be routed under the lower shell and/or upper cuff. In a specific embodiment, all or essentially all of the first tension member and/or the second tension member may be routed under the lower shell and/or upper cuff. For example, all of the first tension member and/or the second tension member may be routed under the lower shell and/or upper cuff except a portion of the first tension member and/or the second tension member that is immediately adjacent the first reel based closure device and/or second reel based closure device.

In some embodiments, a portion of the first tension member and/or the second tension member is routed around the first reel based closure device and/or the second reel based closure device. In some embodiments, the ski boot may include a strap that encircles the upper cuff and that is adjustable to tighten the ski boot about the user's lower leg. In some embodiments, the first reel based closure device and/or the second reel based closure device may be configured to automatically wind or tension the first tension member and/or the second tension member to enable rapid tensioning of the first tension member and/or the second tension member. In some embodiments, the first reel based closure device and/or the second reel based closure device may be positioned on a panel member that is removably coupled with a front portion of the lower shell and upper cuff.

According to another aspect, a method of making a ski boot may include providing a ski boot that includes a lower shell that is configured to couple with a ski binding and an upper cuff that is pivotally coupled with the lower shell. The lower shell may be configured to accommodate a user's foot and the upper cuff may be configured to accommodate a user's lower leg. The method may also include coupling a first tightening system with the lower shell and coupling a second tightening system with the upper cuff. The first tightening system may include a first reel based closure device and a first tension member that is operably coupled with the first reel based closure device so that an operation of the first reel based closure device effects tightening of the first tension member. The first tighten system may also include a plurality of first guide members that are positioned about the lower shell to route or direct the first tension member along a path about the lower shell. The second tightening system may similarly include a second reel based closure device and a second tension member that is operably coupled with the second reel based closure device so that an operation of the second reel based closure device effects tightening of the second tension member. The second tightening system may also include a plurality of second guide members that are positioned about the upper cuff to route or direct the second tension member along a path about the upper cuff. The first tightening system and the second tightening system may be operable independently of each other so as to independently and differentially tightening the lower shell and the upper cuff.

The plurality of first guide members and/or the plurality of second guide members may include a guide member that allows the first tension member and/or the second tension member to be uncoupled from the lower shell and/or upper cuff to enable rapid loosening of a tension in the first tension member and/or the second tension member. At least a portion of the first tension member and/or the second tension member may be routed under the lower shell or upper cuff.

BRIEF DESCRIPTION OF THE DRAWINGS

The present invention is described in conjunction with the appended figures.

Figure 2:
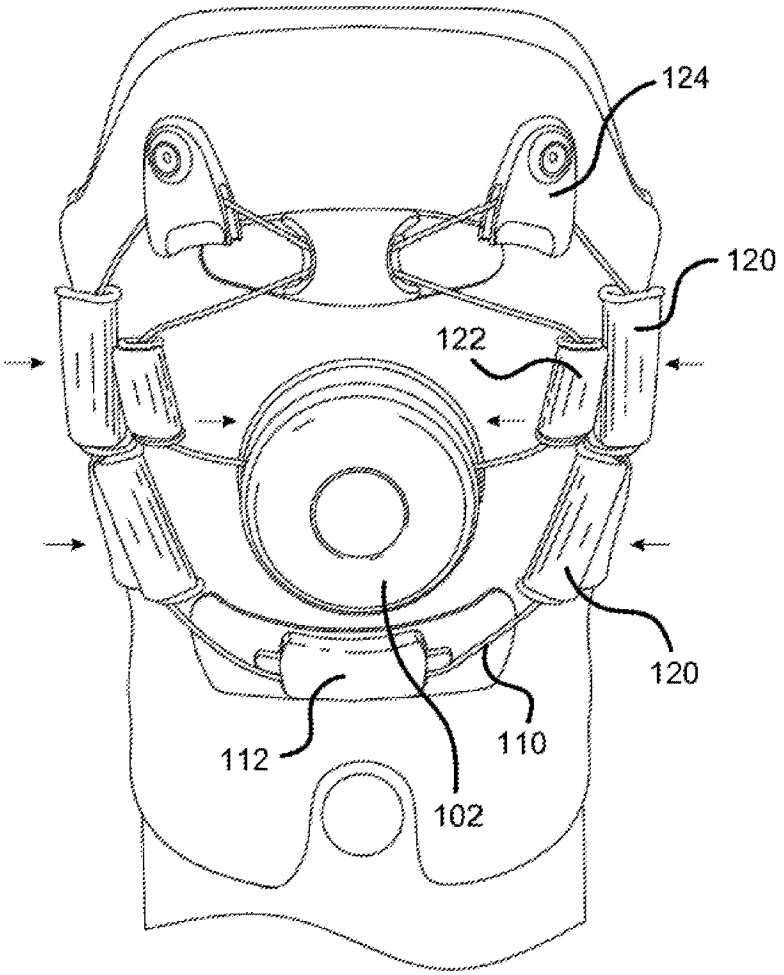
FIG. 2 is a rear view of the ski boot of FIG. 1.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments herein describe reel based closure devices that are attached to alpine or ski boots and that are operable to tension at least a portion of the alpine/ski boot. For ease in describing the embodiments, the boots will be generally referred to as ski boots, although it should be understood that the term is intended to broadly cover any alpine or ski type boot. In particular, the reel based closure devices are typically attached to the exterior of the ski boot, such as the shell, and are used to tighten the exterior of the ski boot about a user's leg and/or foot. The ski boot's exterior is typically made of a rigid material, such as various rigid polymers or plastic materials. The ski boot's rigid exterior shell typically includes multiple parts, such as a lower shell that couples with a ski binding and an upper shell or cuff that is pivotally coupled with the lower shell via a hinge point or cuff adjustment. In many instances, a position or angle of the upper cuff may be adjusted relative to the lower shell via manipulation of the hinge point or cuff adjustment. The lower shell is designed to accommodate a user's foot while the upper cuff is designed to accommodate the user's lower leg.

The reel based closure devices (hereinafter reel based device or reel system) are configured to tension a lace or tension member that is guided about the ski boot via one or more guide members, which may be rigid components that are made of plastic or other materials, or which may be flexible and soft components that are made of fabric materials.

The reel based devices typically include a knob or dial that may be grasped and rotated by a user. The knob or dial is commonly coupled with a spool around which the tension member or lace is wound in response to rotation of the knob or dial in a tightening direction. Rotation of the tension member or lace around the spool tensions the tension member or lace, which tightens the ski boot about a user's foot by constricting the shell and any internal components (i.e., a liner, etc.) about the user's foot. Exemplary reel based devices are further described in U.S. patent application Ser. No. 14/297,047 filed Jun. 5, 2017, and entitled "Integrated Closure Device Components and Methods", and in U.S. Pat. No. 9,259,056, filed Jun. 21, 2013, and entitled "Reel Based Lacing System", the entire disclosures of which are incorporated by reference herein.

The reel based devices described herein may replace traditional buckles and/or other tightening systems that are currently used on ski boots to tighten the ski boot about a user's foot. The reel based devices are significantly easier to operate than traditional buckles and/or other tightening systems. As such, user's may greatly prefer to use the reel based devices in tightening a ski boot. In addition, the reel based devices offer significantly more incremental degrees of tightening and loosening of the ski boot in comparison with traditional buckles and/or other tightening systems. For example, traditional buckles and/or other tightening systems often include a limited number of tightening segments (e.g., teeth, steps, racks, and the like) that are used in tightening the ski boot. For example, traditional buckles often employ 5 to 10 teeth on a rack within which an engagement pin is positioned to tighten the ski boot. The engagement pin is moved proximally or distally about the rack and positioned within a proximal or distal tooth in order to increase or decrease the tightness of the ski boot about the foot. The limited number of tightening segments (e.g., teeth) results in the ski boot being tightened or loosened by greater amounts or degrees and thus, it may be difficult to achieve a desired and comfortable fit.

In contrast, the reel based devices are capable of tightening and/or loosening the ski boot by significantly smaller incremental amounts or degrees. For example, if a minor increase in tightness is desired, the knob of the reel based device may be rotated by a quarter turn or even an eighth of a turn to slightly increase the tension in the tension member. The slight increase in the tension member's tension normally results in a slight increase in the tightness or constriction of the ski boot about the user's foot. This incremental adjustment of the ski boot's tightness may allow a desired and comfortable fit of the ski boot about the foot to be easily achieved.

Figure 1:
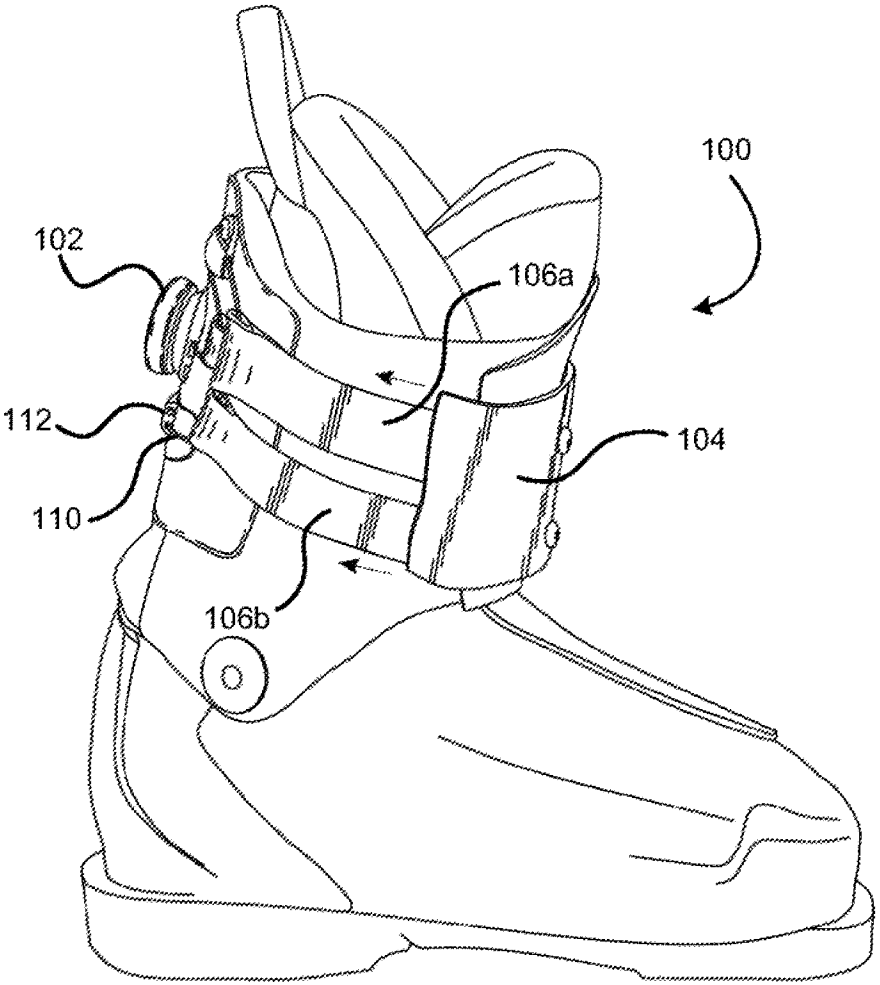
FIG. 1 is a side view of a ski boot that includes a reel based closure device.

Referring to FIG. 1, illustrated is a ski boot 100 that includes a reel based device 102 that is used to constrict the ski boot 100 about a user's leg. The reel based device 102 is attached to a rear surface of the ski boot's upper shell or cuff via mechanical fastening, adhesive bonding, RF or sonic welding, and the like. The reel based device 102 is operably coupled with a tension member 110 that is guided about the rear surface of the skit boot 100 via a plurality of guide members 112 that are also attached to the upper shell or cuff via mechanical fastening, adhesive bonding, RF or sonic welding, and the like. The guide member 112 allows the tension member 110 to slide and shift about the rear surface of the ski boot 110, which allows tension in the tension member 110 to be equalized or normalized, which prevents stress or tension concentrations within the tension member 110.

The tension member 110 is operably coupled with straps, 106*a* and 106*b*, that traverse from the rear surface of the ski boot 100 to a front panel 104. The front panel 104 may be made of a fabric or woven material, or may be made of a more rigid material, such as various plastics, such as those used in forming the rigid exterior shell of the ski boot 100. The front panel 104 may be attached to a front surface of the cuff via mechanical fasteners (e.g., rivets and the like), adhesive bonding, RF or sonic welding, or via any other method known in the art. The straps, 106*a* and 106*b*, may likewise be made of a fabric or woven material, or may be made of a more rigid material, such as from various plastics.

Figure 3:
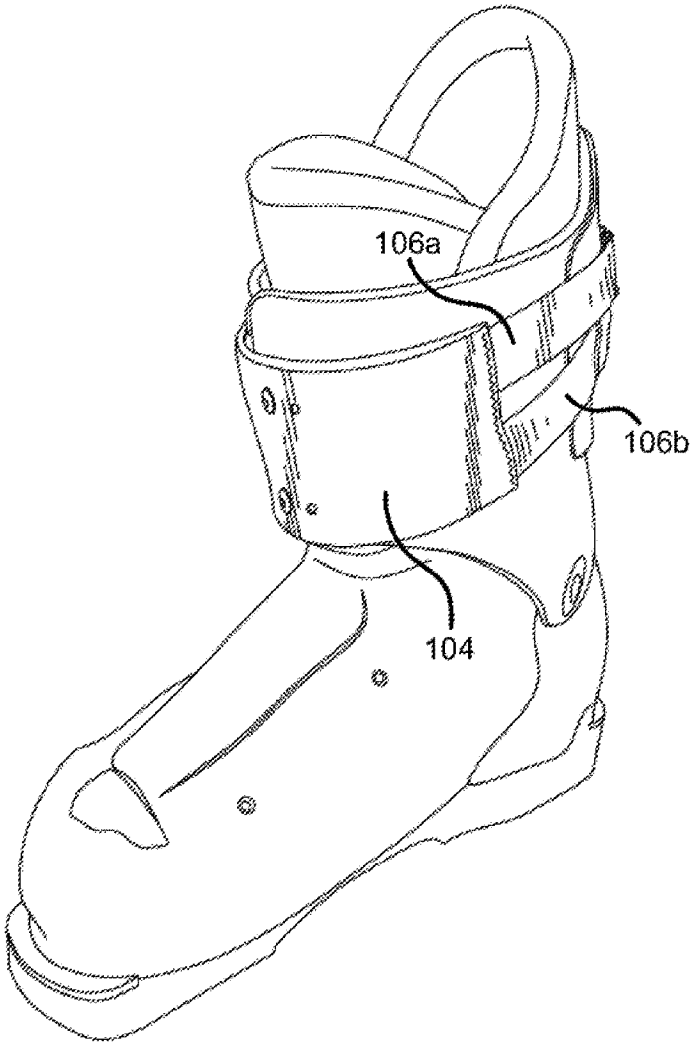
FIG. 3 is a perspective view of the ski boot of FIG. 1.

The straps include an upper strap 106*a* and a lower strap 106*b*. Although the straps, 106*a* and 106*b*, are illustrated on a single sides of the ski boot 100, in some embodiments a similarly arranged pair of straps is positioned on an opposite sides of the ski boot 100 (see FIG. 3). The pair of straps on the opposite side of the ski boot 100 may likewise be operably coupled with the tension member 110 and the front panel 104. A distal end of the straps, 106*a* and 106*b*, is looped and includes a guide member through which the tension member 110 is slidably positioned. The guide member of the straps, 106*a* and 106*b*, may be a rigid plastic material that is configured to minimize friction to enable the tension member 110 to easily slide within the guide member and about the straps, 160*a* and 106*b*.

Tensioning of the tension member 110 via operation of the reel based device 102 causes the straps, 106*a* and 106*b*, to be tensioned and pulled toward the rear surface of the ski boot's cuff, which in turn tensions the front panel 104 and causes the front panel 104 to be pulled rearward toward the reel based device 102. This tensioning cause the cuff to close and constrict about a user's leg that is positioned within the ski boot 100. The reel based device 102 of FIG. 1 may be used to replace traditional buckles and/or other tightening systems, or may be used in combination with these components. The reel based device 102 may also be used to loosen or decrease the tension in the tension member, which loosens the ski boot 100 about the user's leg and allows the cuff to be opened so that the user may remove their foot.

FIG. 2 illustrates a rear view of the ski boot 100 of FIG. 1. FIG. 2 illustrates an arrangement of the reel based device 102 about the rear surface of the ski boot's cuff. The coupling of the reel based device 102 and tension member 110 is illustrated, along with the routing of the tension member 110 about the rear surface of the ski boot 100 and through the various guide members. The guide members include a lower guide member 112 that is positioned below the reel based device 102. The lower guide member 112 directs or routes the tension member 110 between opposing sides of the ski boot 100. A centrally positioned upper guide member (not numbered) may similarly be positioned above the reel based device 102 and used to route or direct the lace between opposing sides of the ski boot 100.

The distal ends of the straps, 106*a* and 106*b*, are also illustrated. FIG. 2 shows that the ski boot 100 may include pairs of straps, 106*a* and 106*b*, on both sides of the ski boot 100 as briefly described above. The distal ends of the straps, 106*a* and 106*b*, are looped 120 with a guide member (not numbered) positioned within the looped ends. The guide members of the looped ends 120 guide or route the tension member 110 between the upper and lower portions of the reel based device 102. As described above, tensioning of the tension member 110 causes the straps, 106*a* and 106*b*, to be tensioned and pulled toward the reel based device 102, which pulls the front panel 104 rearward and constricts the ski boot 100 about the user's legs.

A pair of upper guides 124 are positioned on opposite sides of the centrally positioned upper guide member (not numbered). The upper guides 124 route or direct the tension member 110 between the looped ends 120 of the upper strap 106*a* and the centrally positioned upper guide member. In some embodiments, an additional guide member 122 may be attached to the looped end 120 of the upper straps 106*a*. The use of the additional guide member 122 may cause a greater tension to be applied to the upper strap 106*a* in relation to the lower strap 106*b* since the tension member 110 essentially tensions the upper straps 106*a* twice. The use of the additional guide member 122 may also increase the rearward force that is applied to the upper strap 106*a* and/or lower strap 106*b*.

In some embodiments, the upper and lower straps, 106*a* and 106*b*, may be arranged so that they are separate from one another and independently tensionable. In other embodiments, the upper and lower straps, 106*a* and 106*b*, may be connected and essentially uniformly tensioned. As illustrated in FIG. 2, the tension member 110 may be routed from the reel based device 102, through the additional guides 122, through the centrally positioned upper guide member and the upper guides 124, and then through the looped ends 120 to the lower guide member 112. The illustrated tension member and guide member arrangement has been found to be particularly useful in tensioning the straps, 106*a* and 106*b*, and front panel 104.

Figure 4:
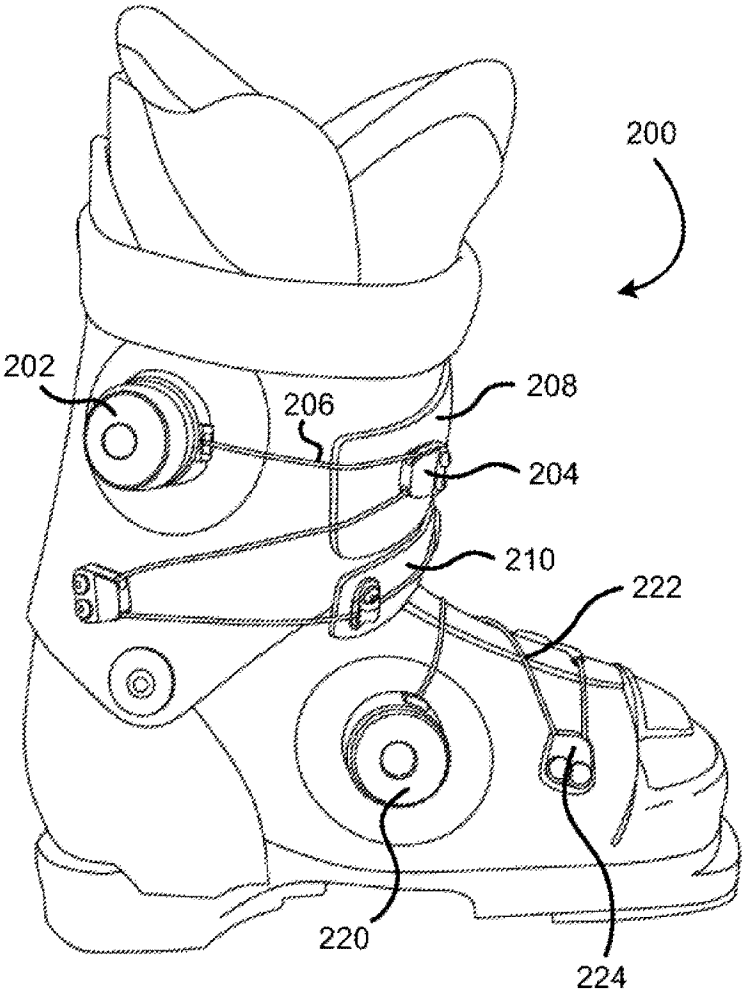
FIG. 4 is a side perspective view of a ski boot that includes a reel based closure device.
Figure 5:
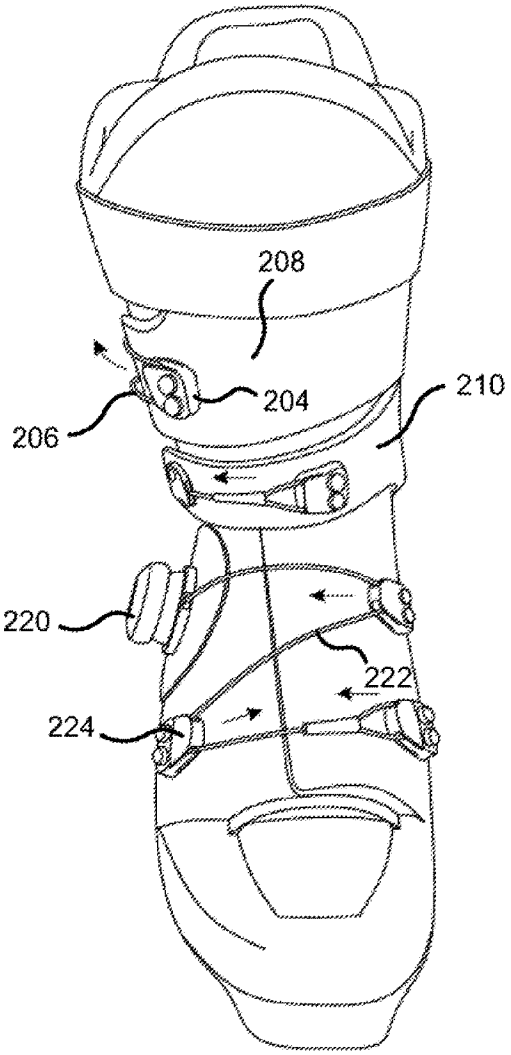
FIG. 5 is a front perspective view of the ski boot of FIG. 4.

FIGS. 4 and 5 illustrate another arrangement of a reel based device about a ski boot 200. Specifically, FIGS. 4 and 5 illustrate the use of two separate tightening systems with one of the tightening systems positioned on the cuff and the other tightening system positioned on the lower shell. Each tightening system includes a reel based closure device, a tension member, and one or more guide members that guide, direct, or route the tension member along a path about the cuff or shell. In some embodiments, one or both tightening systems may include a plurality of guide member that guide, direct, or route the tension member along the path about the cuff or shell. The reel based devices are independently operable to independently and/or differentially tighten the cuff and lower shell as desired. FIG. 4 illustrates a side perspective view of the ski boot 200 while FIG. 5 illustrates a front perspective view of the ski boot 200.

Additional embodiments of ski boots that employ dual or multiple tightening systems are illustrated in FIGS. 10, 13, and 15-21 and are described herein in relation to those figures. Each of these figures may describe various and/or different aspects or features of dual or multiple tightening systems, however, it should be recognized that the various and/or different aspects or features of the dual or multiple tightening systems may be combined and used in any desired combination on a ski boot to achieve a desired fit and/or functionality. As such, it should be recognized that the descriptions of FIGS. 4, 5, 10, 13, and 15-21 are interrelated rather than being independent and isolated. It should be further understood that the description is meant to encompass a claim or claims that include any combination of the aspects and features described herein.

Referring again to FIGS. 4 and 5, a first reel based device 202 is positioned on a side of the ski boot's cuff. The first reel based device 202 is coupled with a tension member 206 that is routed from the side of the cuff and toward the front of the ski boot 200. The tension member 206 is routed through a guide member 204 that is positioned on a distal end of a first panel 208, which is typically part of the ski boot's shell or cuff and made of the same relatively rigid plastic material. The tension member 206 is routed or directed from the guide member 204 and to a guide member (not numbered) that is positioned near the cuff adjuster (not numbered) or ankle portion of the ski boot 200. The tension member 206 is routed from this guide member to one or more guide members (not numbered) that are positioned on a second panel 210, which is also typically part of the ski boot's shell or cuff and made of the same rigid plastic material. A distal end of the tension member 206 terminates at a guide member that is positioned on the second panel 210 as illustrated. An additional pass through guide member (not numbered) may be positioned on a distal end of the second panel 210 in order to ensure that the tension member 206 remains positioned atop the second panel 210 rather than sliding or migrating off the second panel 210.

Tensioning of the tension member 206 via operation of the reel based device 202 tensions the first panel 208 and the second panel 210, which are wrapped around the front portion of the cuff. Tensioning of the first and second panels, 208 and 210, causes the cuff to constrict about the user's leg. In some embodiments, a single panel is used instead of the first panel 208 and the second panel 210. The single panel may be roughly equivalent to the first and second panels, 208 and 210, or may be smaller than the two panels. In other embodiments, three or more panels may be used instead of the first panel 208 and the second panel 210. A single panel or multiple panels may likewise be used in any of the other embodiments described herein.

A second reel based device 220 is attached to a side of the ski boot's lower shell. The second reel based device 220 is operably coupled with a second tension member 222 so that operation of the second reel based device 220 tensions the second tension member 222. The second tension member 222 is routed or directed across the lower shell of the ski boot 200 via a plurality of guide member 224. The second tension member 222 may form a Z pattern or configuration across the front upper surface of the lower shell as illustrated and a distal end of the second tension member 222 may terminate at a distally most positioned guide member.

Operation of the second reel based device 220 causes the second tension member 222 to be tensioned, which causes the lower shell to be constricted and tightened about a user's foot by pulling opposing sides of the lower shell toward one another. The second reel based device 220 is operable independently of the first reel based device 202, which allows the lower shell to be tightened independently of the cuff.

Figure 6:
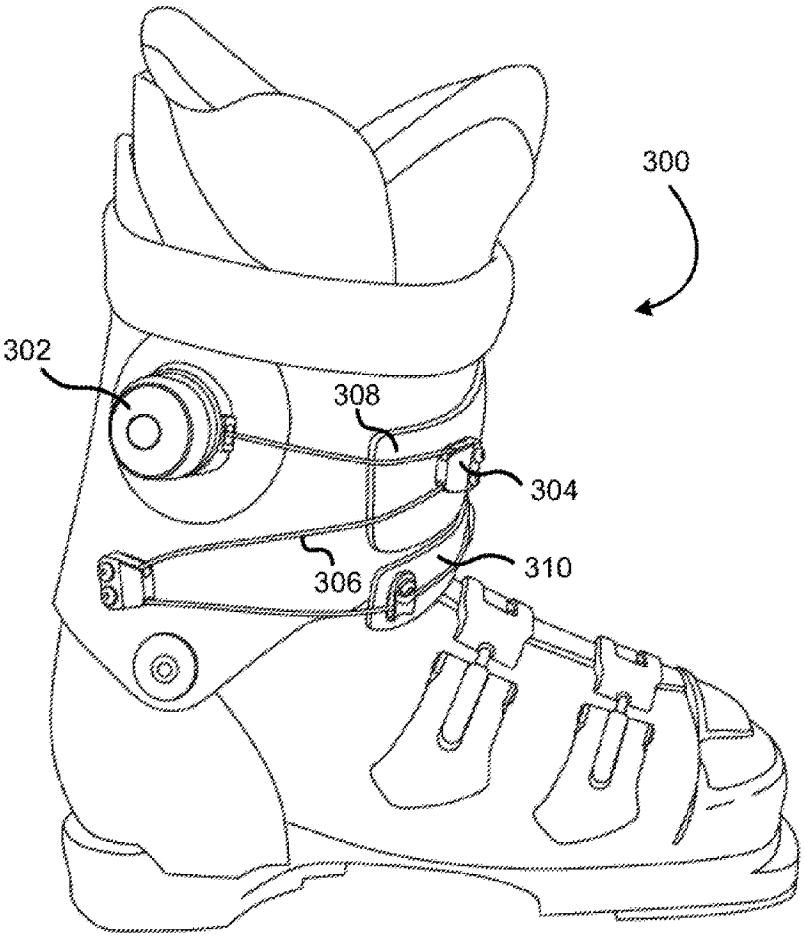
FIGS. 6-7 illustrate examples in which reel based devices are used in cooperation with a buckle system.
Figure 7:
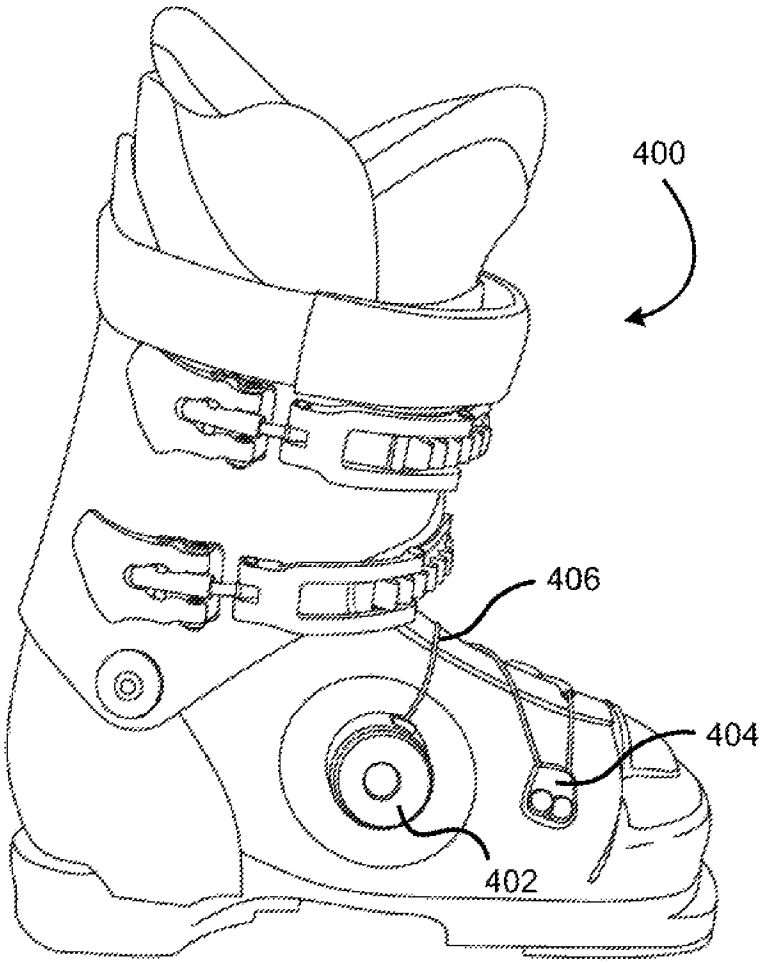

The first and second reel based devices, 202 and 220, may replace traditional buckles or other tightening mechanisms so that the ski boot 200 is free of buckles or other tightening mechanisms. In other embodiments, the first and/or second reel based devices, 202 and 220, may be used in cooperation with buckles or other tightening mechanisms. FIGS. 6 and 7 illustrate examples in which reel based devices are used in cooperation with a buckle system. In FIG. 6, a reel based device 302 is attached to the cuff of the ski boot 300. The reel based device 302 is operably attached to a tension member 306 that is guided or routed about a first panel 308 and a second panel 310 via a plurality of guide members 304. The reel based device 302, the tension member 306, the guide members 304, and the first and second panels, 308 and 310, have an arrangement about the upper cuff that is similar to that illustrated in FIGS. 4 and 5. The reel based device 302 is operable to tighten the cuff as described in relation to FIGS. 4 and 5.

The ski boot 300 includes a pair of traditional or conventional buckles that are positioned on the lower shell of the ski boot 300. The buckles are used in a conventional manner to tighten or constrict the lower shell about the user's foot. In this manner, the reel based device 302 is used to tighten the cuff while the buckles are used to tighten the lower shell.

FIG. 7 illustrates a ski boot 400 that includes a reel based device 402 that is attached to the lower shell of the ski boot 400. The reel based device 402 is operably attached to a tension member 406 that is routed about the lower shell, via guide members 404, as illustrated in FIGS. 4 and 5 and described in relation thereto. The reel based device 402 is operable to constrict and tighten the lower shell about the user's foot as previously described. The ski boot includes a pair of traditional or conventional buckles that are positioned on the cuff of the ski boot 400. The buckles are used in a conventional manner to tighten or constrict the cuff of the ski boot 400 about the user's leg. In this manner, the reel based device 402 is used to tighten the lower shell while the buckles are used to tighten the cuff. In some embodiments, the ski boot 400 may also include a strap (i.e., power strap) that is positioned around the top of the cuff. The strap may include hook and loop fastener materials that enable the strap to be tensioned and coupled about the top portion of the cuff.

Figure 8:
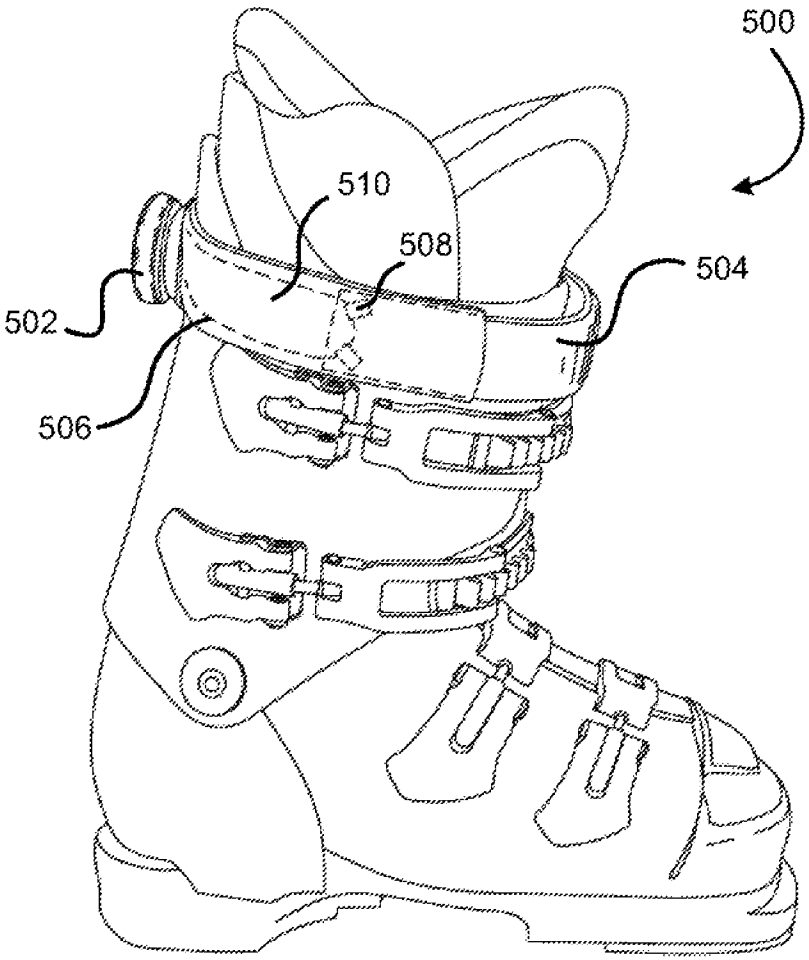
FIG. 8 illustrates an embodiment in which a reel based closure device is used to tension a strap about a top portion of a ski boot cuff.

FIG. 8 illustrates an embodiment in which a reel based device 502 is used to tension a strap or power strap about the top portion of a cuff of a ski boot 500. The ski boot 500 may include conventional buckles or other tightening mechanisms that are positioned about the cuff and lower shell and that are operable in a conventional manner to tighten these portions of the ski boot 500 about the user's foot and leg. The reel based device 502 may be positioned on a rear surface of the top portion of the cuff and may be operably coupled with a tension member 506. The tension member 506 may be disposed within an interior channel of a first or rear strap 510. The tension member 506 may be routed through a guide member 508 that is positioned on a distal end of a second or front strap 504. In some embodiments, the guide member 508 may be a pair of fabric loops that cooperate to guide or route the tension member 506 about the distal end of the second strap 504.

The distal end of the second strap 504 may be slidingly disposed within the interior channel of the first strap 510 so that the second strap 504 is able to slide proximally and distally within the interior channel of the first strap 510. The reel based device 502 is operable to tension the tension member 506, which causes the second strap 504 to be tensioned and to slide distally or rearward within the interior channel of the first strap 510. Distal or rearward sliding of the second strap 504 within or relative to the first strap 510 causes the second strap 504 to be pulled against the front upper portion of the cuff, which causes the cuff to constrict inward against the user's leg and/or prevents the cuff from opening as the user flexes and bends during use of the ski boot 500. The use of the reel based device 502 on the power strap 500 of FIG. 8 may render the power strap more easy to use in comparison with conventional straps. In addition, although the power strap of FIG. 8 is illustrated as being used with conventional buckles or tightening mechanisms on the lower shell and cuff of the ski boot 500, it should be realized that the power strap may be employed on any of the embodiments herein and thus, may be used on ski boots where a reel based device is employed on the cuff and/or shell.

Figure 9:
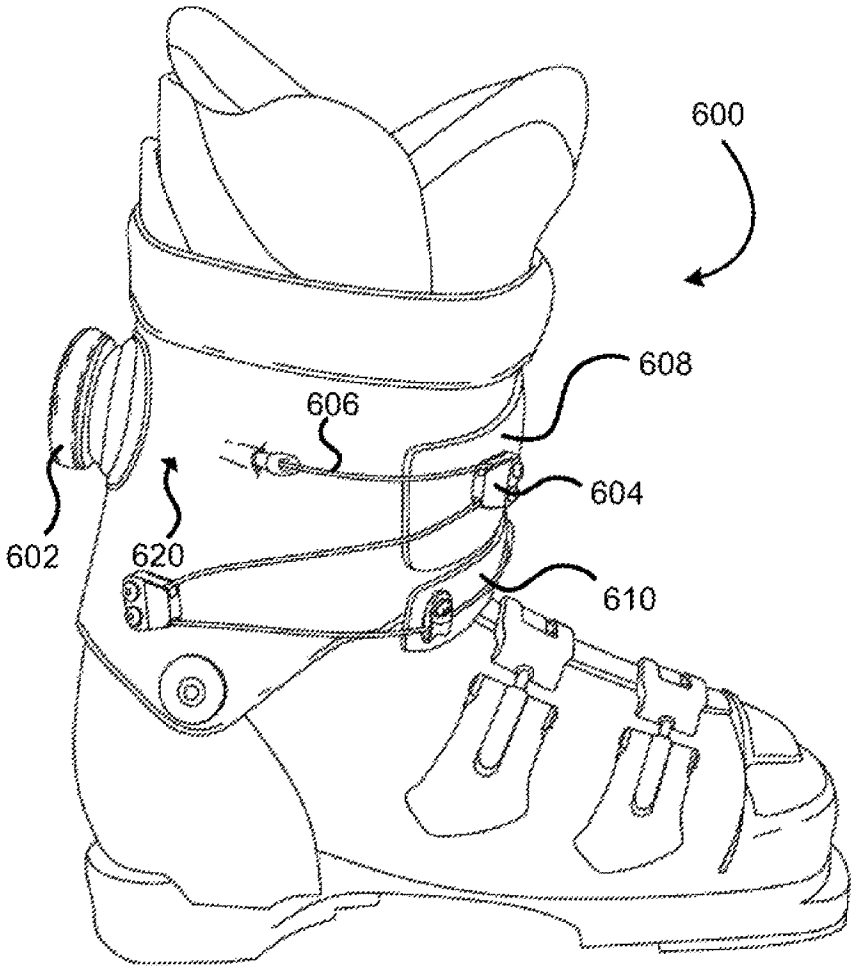
FIG. 9 illustrates another embodiment of a ski boot that employs a reel based closure device.

FIG. 9 illustrates another embodiment of a ski boot 600 that employs a reel based device. The ski boot 600 of FIG. 9 is similar to the ski boot 300 of FIG. 6 in that a tension member 606 is routed about a first panel 608 and a second panel 610 via multiple guide members 604. The ski boot 600 of FIG. 9 differs from the previous embodiment, however, in that the reel based device 602 is positioned on a rear surface of the ski boot's cuff and further differs in that a portion of the tension member 606 is routed under a surface of the cuff 620. The tension member 606 may be routed under the cuff 620 via one or more sections of tubing that are positioned under the ski boot's shell. In other embodiments, the inner surface of the cuff 620 may form a channel or slot within which the tension member 606 is positioned and routed. Routing of the tension member 606 under the cuff 620 prevents or minimizes interference of the tension member 606 with surrounding objects and/or may provide a visually pleasing appearance that user's prefer.

The tension member 606 is shown as being routed under the cuff 620 between the reel based device 602 and the first panel 608. In other embodiments the tension member 606 may be routed elsewhere under the cuff or multiple portions of the tension member 606 may be routed under the cuff. For example, a section of the tension member between the first panel 608 and the second panel 610 may be routed under the cuff to minimize the appearance of the tension member 606 above the cuff. In such embodiments, the guide member that is positioned near the ankle or cuff adjuster may be positioned under the surface of the cuff.

Figure 10:
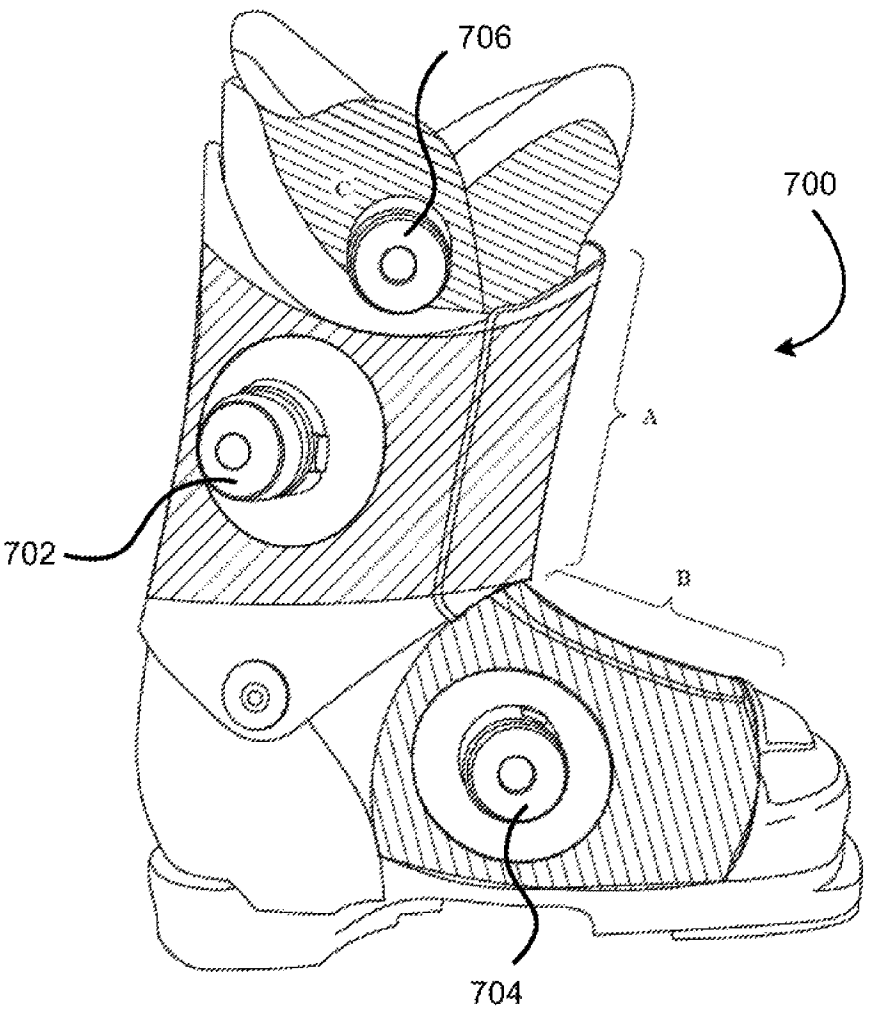
FIG. 10 illustrates multiple reel based closure devices being employed to tighten different portions of a ski boot.

FIG. 10 illustrates that multiple reel based devices may be employed to tighten different portions of a ski boot 700. Specifically, a first reel based device 702 may be coupled with the ski boot's cuff to tighten a first portion A of the ski boot 700. The first portion A of the ski boot that is affected by the first reel based device is illustrated by the cross-hatchings immediately adjacent the first reel based device 702. A second reel based device 704 may similarly be coupled with the ski boot's lower shell to tighten a second portion B of the ski boot 700. The second portion B of the ski boot 700 that is affected by the second reel based device 704 is illustrated by the cross-hatchings immediately adjacent the second reel based device 704. A tightening system (e.g., third reel based device 706) may be coupled with the ski boot's liner, or an upper portion of the cuff (e.g., a power strap) to tighten a third portion C of the ski boot 700. The third portion C of the ski boot that is affected by the third reel based device 706 is illustrated by the cross-hatchings immediately adjacent the third reel based device 706. The third tightening system coupled may be configured to effect tightening of the liner. The third tightening system may include the third reel based device 706, a tension member (not shown) that is operably coupled with the third reel based device 706, and one or more guide members (not shown) that are positioned about the liner to route or direct the tension member along a path about the liner. Operation of the third reel based device 706 may effect tightening of the tension member, and thereby tightening of the liner.

The first reel based device 702, the second reel based device 704, and the third reel based device 706 are each independently operably to independently tighten the respective portions of the ski boot 700. The independent tightening of the different portions of the ski boot 700 allows a customized fit and feel of the ski boot 700 to be achieved. In addition, the minor incremental adjustment that is enabled by the reel based devices (702, 704, and 706) enables an increased customized fit and feel of the ski boot 700 to be achieved.

Figure 12:
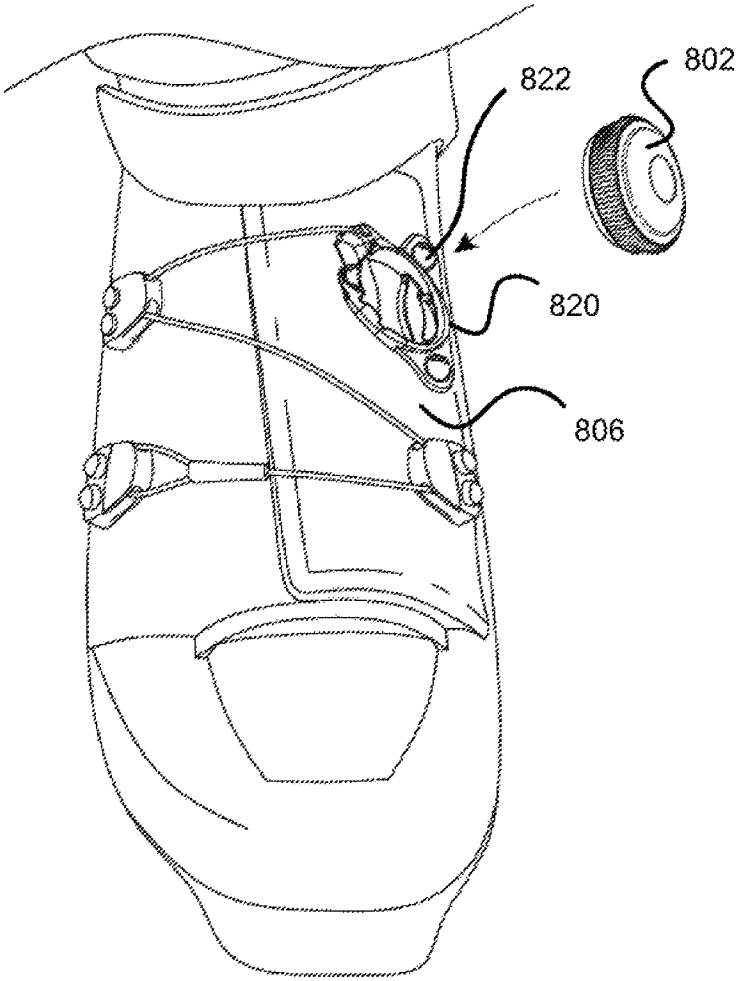
FIG. 12 illustrates a base member that is fixedly secured to a lower shell of a ski boot.
Figure 11:
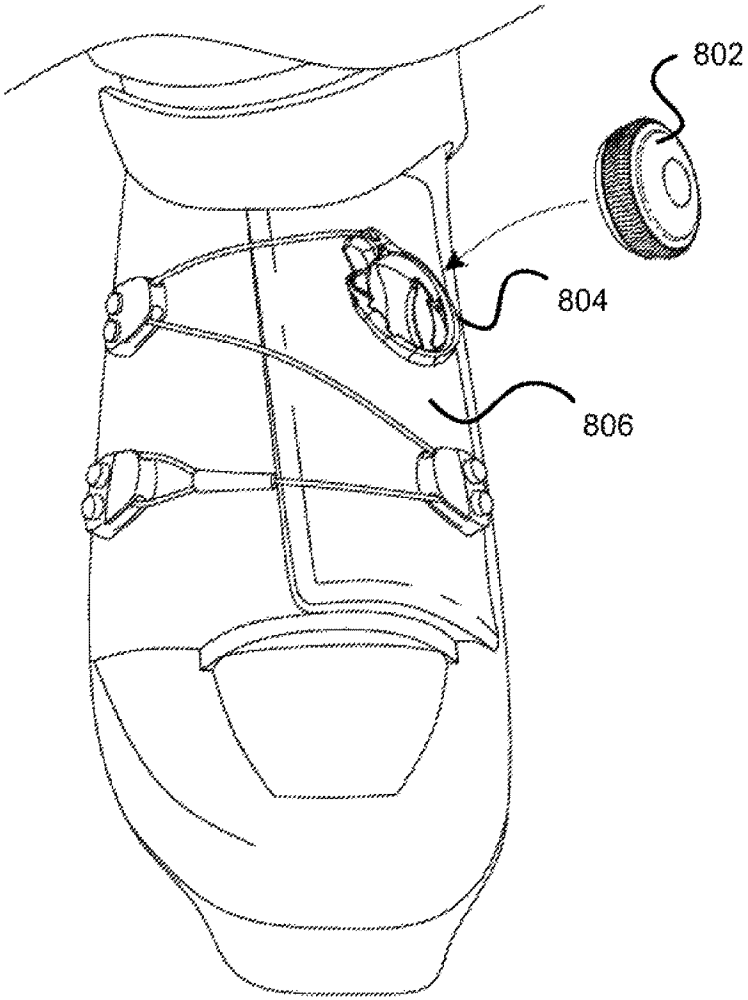
FIG. 11 illustrates a ski boot that includes a base member that enables a reel based closure device to be detached and removed from a ski boot.

FIGS. 11 and 12 illustrate reel based devices that are removable from the ski boot. Specifically, FIG. 11 illustrates a ski boot that includes a base member 804 that enables the reel based device 802 to be detached and removed from the ski boot. The reel based device 802 may comprise a housing, a knob, a spool, and a pawl mechanism or other friction holding mechanism, such as those describe in the '047 patent application and the '056 patent that are incorporated by reference herein. The base member 804 includes features that enable the reel based device 802 to be quickly and easily removed from the ski boot. Exemplary embodiments of base members (also called bayonets) that are detachable from reel based devices are further described in the '047 patent application and in U.S. Pat. No. 9,101,181, filed Oct. 13, 2011, entitled "Reel-Based Lacing System", and in U.S. patent application Ser. No. 11/263,253, filed Oct. 31, 2005, entitled "Reel Based Closure System," the entire disclosures of which are incorporated by reference herein.

FIG. 11 illustrates that the base member 804 may be integrally formed with the lower shell 806 of the ski boot, such as by insert molding the base member 804 within the lower shell. FIG. 12 illustrates a base member 820 that is fixedly secured to the lower shell 806 of the ski boot after the lower shell is separately formed. The base member 804 may be mechanically fastened to the lower shell 806 via rivets 822 or via any other mechanical fastener. In other embodiments, the base member 820 may be adhesively bonded with the lower shell 806, RF or sonically welded with the lower shell 806, or attached via any other means.

While FIGS. 11 and 12 illustrate the base members, 804 and 820, attached to the ski boot's lower shell, it should be realized that the base members, 804 and 820, may be positioned anywhere else on the ski boot's shell, such as on the cuff, on a rear surface of the cuff or lower shell, on the front surface of the cuff or lower shell, and the like.

Figure 13:
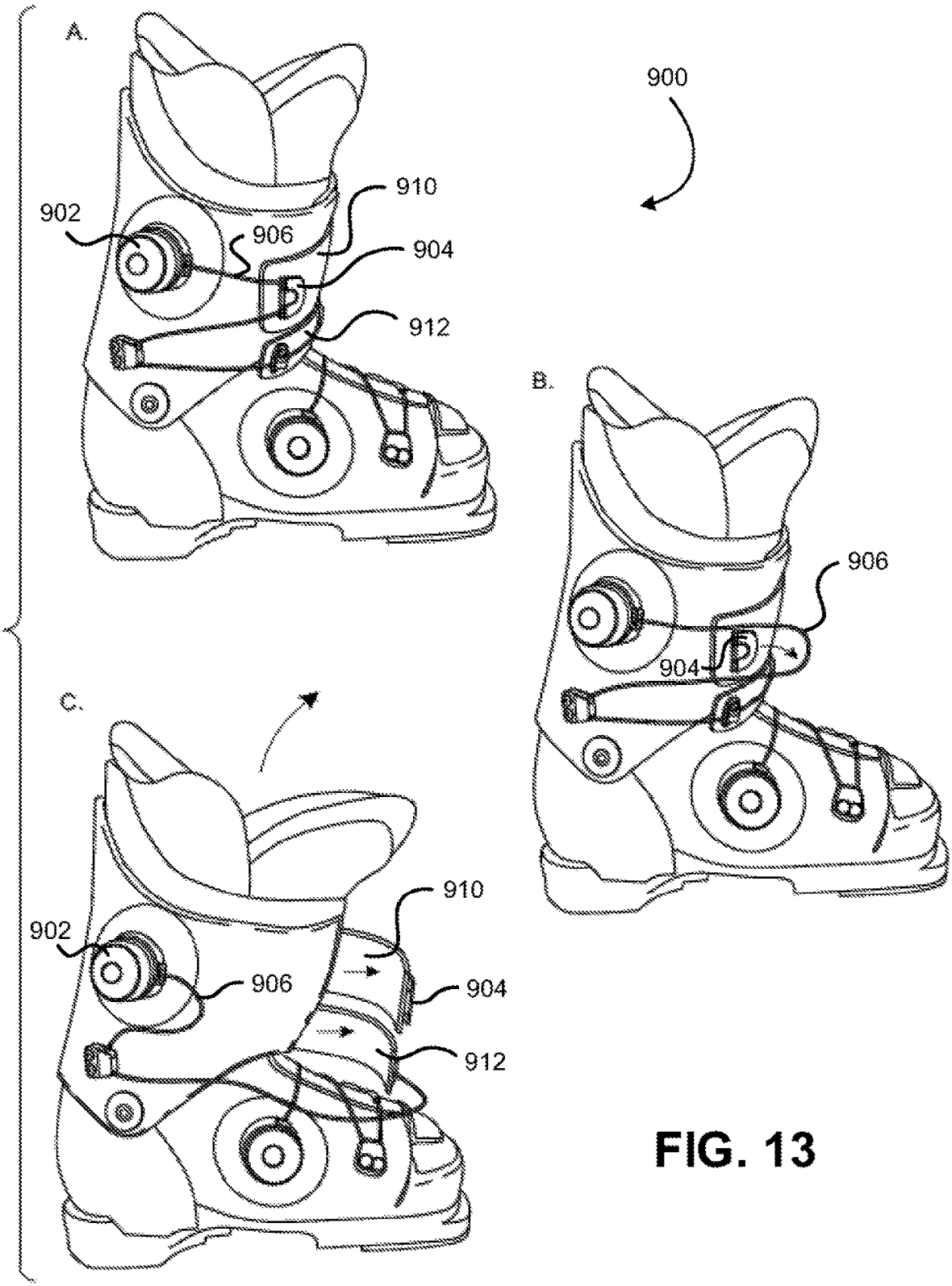
FIG. 13 illustrates a gross adjustment method that may be employed to allow a ski boot's shell to be quickly opened.

FIG. 13 illustrates a gross or macro adjustment method that may be employed to allow a ski boot's shell to be quickly and easily opened. Specifically, the ski boot 900 includes a guide member 904 that is designed to allow the tension member 906 to be quickly uncoupled from the guide member 904, which allows the first and/or second panels, 910 and 912, to be opened to loosen the ski boot about the user's foot. The guide member 904 enables rapid loosening of a tension in the tension member 906. The guide member 904 includes an open channel or back (not shown) that allows the tension member 906 to be inserted within and removed from the channel in order to couple and uncouple the tension member 906 from the guide member 904.

FIG. 13 illustrates a sequence beginning with image A in which the tension member 906 is initially coupled with the guide member 904 and in which the first and second panels, 910 and 912, are positioned across the front portion of the cuff. In image B the tension member 906 is removed from the guide member 904 by removing the tension member 906 from the guide member's open channel. In image C the first and second panels, 910 and 912, are pulled away from the front portion of the cuff, which causes the tension member 906 to be pulled toward the reel based device 902. The sequence illustrated in images A-C show how the tension member 906 may be removed from the guide member 904 to loosen the ski boot 900 about the foot. The process can be performed in reverse to attach or couple the tension member 906 with the guide member 904 and thereby initially tighten the ski boot 900 about the foot.

While the guide member 904 is illustrated as being positioned on the first panel 910, in other embodiments the guide member 904 may be positioned elsewhere, such as on the second panel 912, on one or more portions of the lower shell, on a combination of the lower shell and upper cuff, and the like. An exemplary embodiment of a guide member with an open back or channel is further described in the '056 patent that is incorporated by reference herein.

Figure 14:
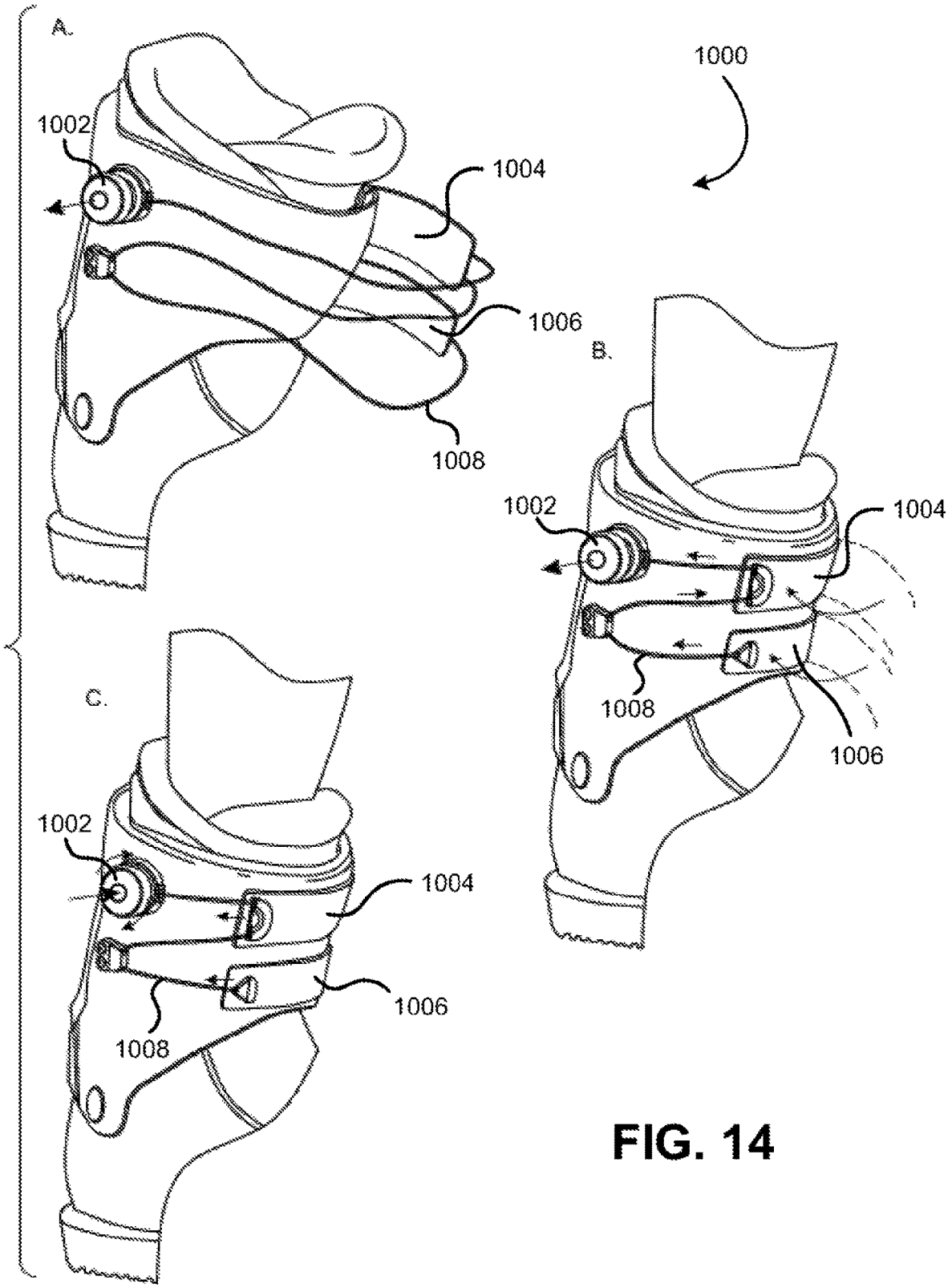
FIG. 14 illustrates a reel based closure device that automatically winds a tension member to rapidly tension the tension member.

FIG. 14 illustrates a reel based device 1002 that is designed to automatically wind or tension a portion of the tension member 1008 in order to eliminate slack in the system and thereby enable rapid tensioning of the tension member 1008. The term "slack" refers to the tension member being essentially un-tensioned, or having a tension that is less than a given minimal threshold. Slack in the system may occur after the cuff of the ski boot 1000 is pulled open to allow a user to remove their foot or after the user inserts their foot in the ski boot 1000 and releases the cuff.

In image A, the tension member 1008 is illustrated as being coupled with the reel based device 1002 and with first and second panels, 1004 and 1006. A substantial amount of slack exists in the tension member 1008. In image B, the user has inserted their foot within the ski boot 1000 and the tension member 1008 has been automatically wound by the reel based device 1002 to eliminate the slack in the tension member 1008. The automatic winding of the tension member 1008 by the reel based device 1002 pulls the first panel 1004 and the second panel 1006 into engagement with a front portion of the cuff and may initially tighten the ski boot 1000 about the user's leg. In some embodiments, the reel based device 1002 may include a spiral spring, or any other mechanism, that is configured to cause the spool to automatically rotate within the reel based device 1002 and thereby automatically wind or tension the tension member 1008. An exemplary embodiment of a mechanism that is configured to automatically rotate a spool and tension a tension member is further described in the '253 patent application, which is incorporated by reference herein.

In image C, after the tension member 1008 is automatically wound or tensioned via the reel based device 1002, the reel based device 1002 may be operated to further tension the tension member 1008 and thereby further tighten the ski boot 1000 about the user's leg. While the reel based device 1002 is illustrated as being positioned on the cuff, in other embodiments the reel based device 1002 may be positioned elsewhere, such as on the lower shell and the like.

Figure 16:
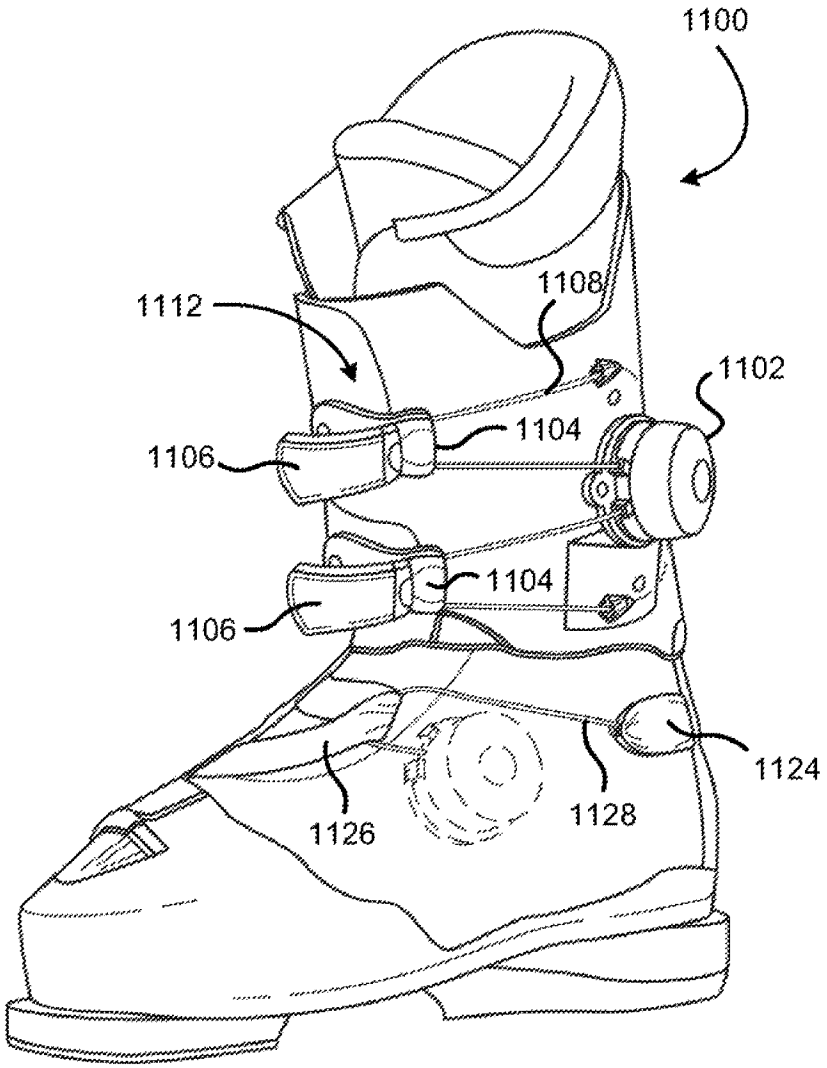
FIGS. 15-16 illustrate another embodiment of a reel based closure device that is attached to a ski boot.
Figure 15:
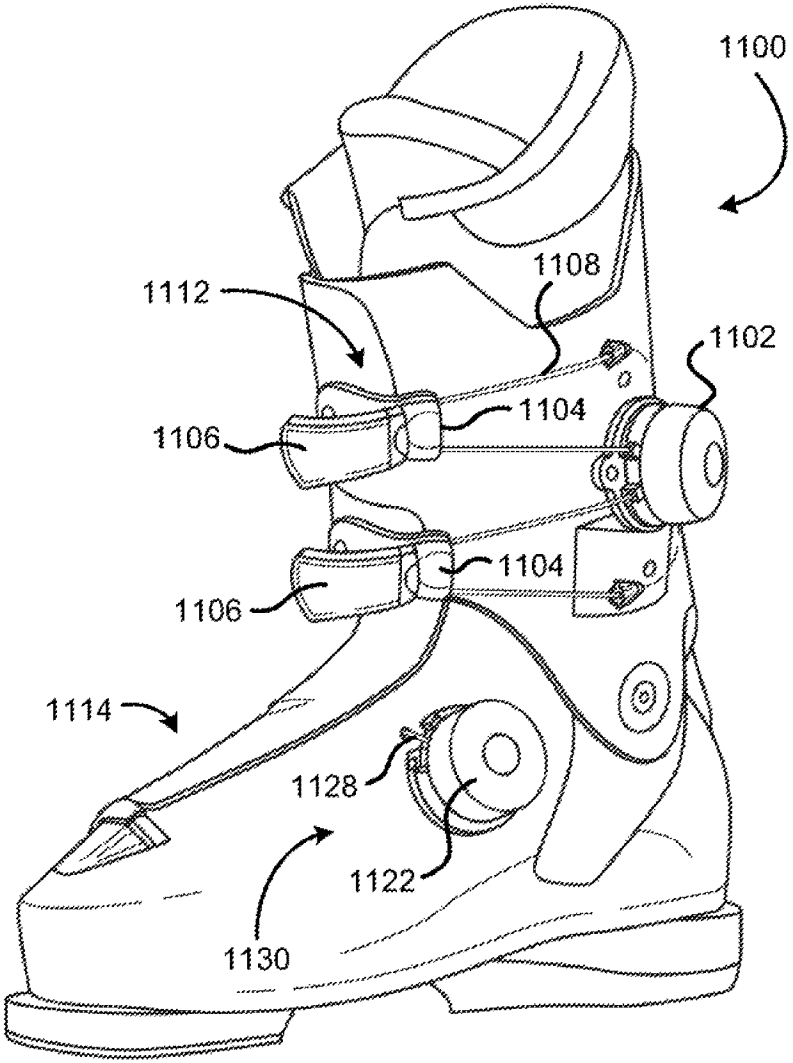

FIGS. 15 and 16 illustrate another embodiment of a reel based device that is attached to a ski boot 1100. The figures illustrate a specific lacing pattern that has been found to be effective in closing and tightening an upper and lower cuff of the ski boot 1100. The system includes an upper reel based device 1102 that is designed to close and tighten an upper cuff about a user's leg, and further includes a lower reel based device 1122 that is designed to close and tighten a lower cuff about the user's leg. The upper reel based device 1102 is attached to an upper tension member 1108 in a manner that allows the tension member to be tightened by an operation of the upper reel based device 1102, and more specifically a rotation of a knob of the upper reel based device 1102 in a tightening direction. The tension member 1108 is coupled with a pair of guide bodies or guides 1106 (hereinafter guides 1106) that are configured to be releasably attached with corresponding base members or guide bases 1104 (hereinafter guide bases 1104) that are fixedly secured or attached to an upper panel 1112 that is wrapped partially around the upper cuff. The guides 1106 and guide bases 1104 are similar to those illustrated in FIGS. 17 and 18 and are designed to allow a user to grasp and remove the guides 1106 from the guide bases 1104 in order to allow tension in the tension member 1108 to be quickly released and thereby allow the user to quickly don or doff the ski boot 1100. In some embodiments, one of the guides 1106 may be releasable from the guide base 1104 while the other guide is fixedly secured or attached to the guide base 1104. In such instances, the non-removable guide and guide base are typically integrated so that the guide is a single component that is attached to the ski boot 1100. The guide bases 1104 are typically fixed or anchored to the upper cuff. To anchor the guide bases 1104 to the upper cuff, the guide bases 1104 could be attached via a mechanical fastener, such as a rivet or screw, or could be molded directly into the material of the upper cuff. In some embodiments, the guides 1106 include a magnet and the guide bases 1156 include an oppositely polarized magnet. The magnets assist in placement of the guides 1106 within the guide bases 1104.

The guides 1106 commonly include a tab or grip surface that extends away from the guide base 1104. The tab or grip surface enables the user to easily grasp the guide 1106 and pull the guide 1106 away from the guide base 1104 or align the guide 1106 with the guide base 1104 during attachment of the two components. While the tab is illustrated as a relatively large protruding component, the tab may have essentially any size or shape that is conducive to allowing the tab to be gripped and pulled by the user. For example, the size and shape of the tab may be selected to optimize the size of the grip surface while minimizing the chance of the tab catching or snagging on surrounding objects. In some instances, the tab may be a strap or fabric material. Additional configurations of the tab are provided in FIGS. 19 and 20.

The upper reel based device 1102 is typically centrally positioned between the guides 1106 so that an upper portion of the tension member 1108 exits the upper reel based device 1102 and immediately traverses to an upper guide 1106 and so that a lower portion of the tension member 1108 exits the upper reel based device 1102 and immediately traverses to a lower guide 1106. These portions of the tension member 1108 form or define a central path of the tension member about the upper cuff. The tension member 1108 is slidably positioned within the upper and lower guides 1106 so that as the tension member 1108 is tensioned via the upper reel based device 1102, the tension member 1108 slides within a channel of the respective guides 1106. The tension member 1108 is routed via the guides 1106 back toward the upper reel based device 1102. The tension member 1108 may be fixedly secured to the upper cuff of the ski boot 1100 near the upper reel based device 1102, or more commonly, the tension member 1108 is routed around the upper reel based device 1102 via tubing that is positioned under the exterior surface of the upper cuff (see FIG. 18). When the tension member 1108 is routed behind the upper reel based device 1102, the upper reel based device 1102 is essentially enclosed, or surrounded, by the tension member 1108.

The path or configuration of the tension member 1108 ensures that the tension applied to the upper cuff is essentially even or uniform, which helps ensure that the force that is exerted on the user's leg via the upper cuff is roughly uniform. The ski boot 1100 may include additional guides 1106 and guide bases 1104 as desired. In such instances, the upper reel based device 1102 is typically positioned so that it is central relative to the guides 1106 and guide bases 1104. In other instances, the upper reel based device 1102 may be offset in relation to the guides 1106 and guide bases 1104, such as by being positioned nearer to an upper end of the tension member path or nearer to a lower end of the tension member path (see FIG. 20). In some embodiments, opposing ends of the tension member 1108 are operationally attached to the upper reel based device 1102 so that an operation of the upper reel based device (e.g., rotation of the knob in the tightening direction) causes both opposing ends of the tension member 1108 to be simultaneously tensioned. In other embodiments, only one end of the tension member 1108 is operationally attached to the upper reel based device so that an operation of the device tensions only one end of the tension member 1108.

The lower reel based device 1122 is attached to a lower tension member 1128 in a manner that allows the tension member to be tightened by an operation of the lower reel based device 1122, and more specifically a rotation of a knob of the lower reel based device 1122 in a tightening direction. The tension member 1128 is covered and concealed by the lower cuff 1130 and by a lower panel 1114 that is wrapped at least partially around the lower cuff 1130. The lower reel based device 1122 is attached to the exterior of the lower cuff 1130 so that it is accessible to the user. A proximal portion of the tension member 1128 that is immediately adjacent the lower reel based device 1122 may be positioned atop the exterior of the lower cuff 1130, or may be routed immediately under the lower cuff 1130 as it exits the lower reel based device 1122.

FIG. 16 illustrates a portion of the lower cuff 1130 removed and illustrates the lower tension member 1128 positioned within the lower cuff 1130 and guided about a path within the lower cuff. Specifically, the tension member 1128 is guided about the path via a first guide 1126 and a second guide 1124. The tension member 1128 commonly terminates at the second guide 1124 or is fixedly secured to the second guide 1124, although in other embodiments, the tension member 1128 may be guided toward or to the lower reel based device 1122 by the second guide 1124. The tension member 1128 is routed via the first guide 1126 from the lower reel based device 1122 toward the heel of the ski boot 1100 and to the second guide 1124. The tension member 1128 may be positioned above or below the lower reel based device 1122 as it is routed from the first guide 1126 and toward the second guide 1124.

In some embodiments, the first guide 1126 is attached to the lower panel 1114 so that tensioning of the tension member 1128 causes the lower panel 1114 to wrap more securely around or about the lower cuff 1130. In other embodiments, the first guide 1126 and/or second guide 1124 is freely positioned within the ski boot 1100 so that the first guide 1126 and/or second guide 1124 sit atop a liner of the ski boot. In such embodiments, tensioning of the tension member 1128 causes the ski boot's liner to constrict about the user's leg. The first guide 1126 and/or the second guide 1124 may be formed of a strip of fabric or other flexible material. The guide may be formed by folding, wrapping, or bending the strip of fabric to form a loop within which the tension member 1128 is positioned as illustrated in FIG. 16. In such embodiments, the first guide 1126 and the second guide 1124 may be formed of the same strip of fabric with the second guide 1124 being a distal end of the strip of fabric that wraps around an opposite side of the ski boot's liner. This configuration may increase the amount of constriction of the liner about the user's leg as the tension member is tensioned. A material component (not shown) may be positioned under the tension member 1128 to decrease pressure points that may otherwise be created on the liner as the tension member is tensioned.

While the tension member 1108 is illustrated as being positioned atop the upper cuff, in some instances the tension member 1108 may be routed underneath the upper cuff in a manner similar to the routing of the tension member 1128 under the lower cuff. Tubing or other lace routing means may be used to route the tension member 1108 under the upper cuff. In such embodiments, the tension member 1108 may be routed to a position near the guides 1106 in order to allow the user to employ the guides as described herein. Routing the tension member 1108 under the upper cuff allows the upper cuff to remain visually appealing and also aids in protecting the tension member 1108 from unwanted contact with nearby objects. In addition, the tension members described herein may be made of various materials, but are typically made of materials that are capable of withstanding substantial tension loads. In a specific embodiment, the tension member is made of a textile based material or a steel based material. While the guides 1106 are illustrated as being positioned on the upper cuff, in some instances one or more guides 1106 may be positioned on the lower shell and/or on the lower shell and upper cuff.

Figure 18:
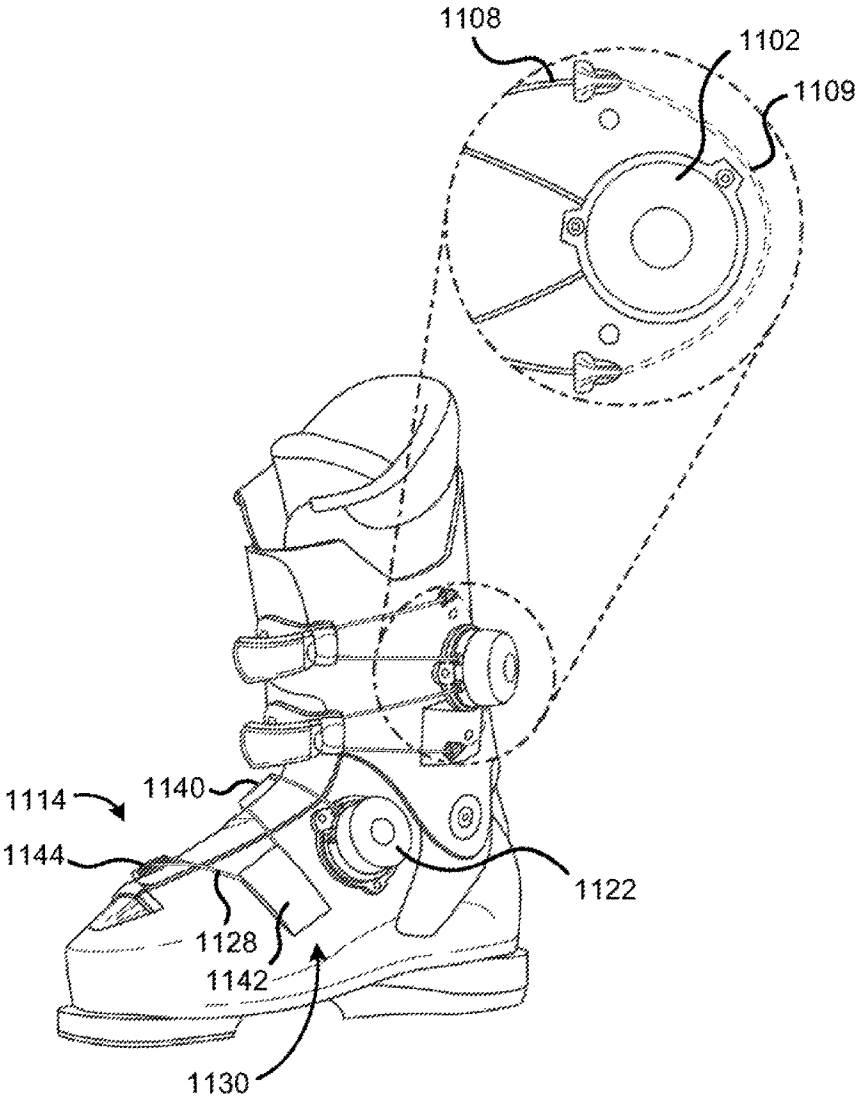
FIGS. 17-18 illustrate another embodiment of a reel based closure device attached to a ski boot.
Figure 17:
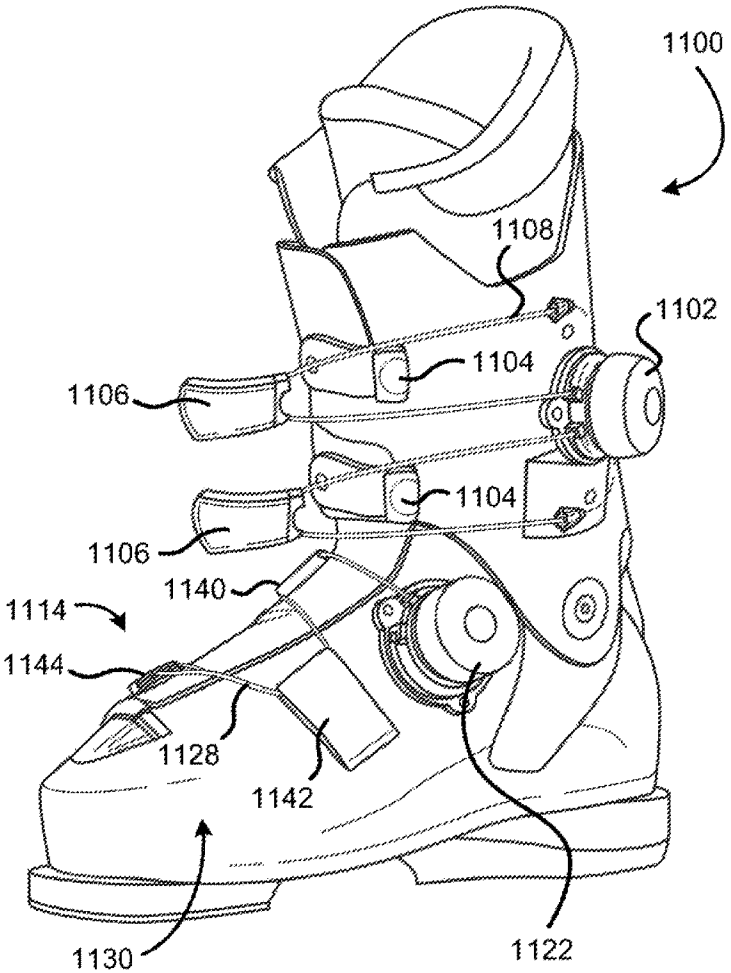

FIGS. 17 and 18 illustrate another embodiment of a reel based device that is attached to a ski boot 1100. The ski boot includes the upper reel based device 1102 and the lower reel based device 1122 as previously described. The upper reel based device 1102 and tension member 1108 have the same configuration as described in relation to FIGS. 15 and 16. FIG. 17 illustrates the guides 1106 in a detached or uncoupled state from the guide bases 1104. A distal end of the guides 1106 is designed to fit within a channel or slot of the guide bases 1104. Specifically, the distal end of the guides 1106 is shaped to correspond to a shape of the channel or slot of the guide bases 1104, which enables mating engagement of the distal end of the guides 1106 within the guide bases' channel or slot. A more detailed description of the mating of the guides 1106 and guide bases 1104 is provided in U.S. patent application Ser. No. 16/181,003, filed Nov. 5, 2018, and entitled "Reel Based Lacing System", the entire disclosure of which is incorporated by reference herein. In some embodiments, the guide base 1104 includes a laterally extending seat or finger that is sized and shaped similar to the guide's tab. The laterally extending seat or finger is designed so that the guide's tab rest atop or is positioned immediately adjacent to the seat or finger to minimize contact between the guide's tab and the upper cuff. FIG. 18 illustrates the tubing 1109 that is positioned under the upper cuff and around the upper reel based device 1102. The tubing 1109 is used to route the tension member 1108 under the upper cuff and around the upper reel based device 1102.

The lower reel based device 1122 is positioned on the exterior of the lower cuff 1130 as in FIGS. 15 and 16. The tension member 1128 is also positioned atop the lower cuff 1130 and is guided about a path atop the lower cuff 1130 via a plurality of guides. The tension member 1128 is routed so that the tension member traverses between opposing sides of the lower panel 1114. A first guide 1140 and a third guide 1144 are attached to the lower panel 1114 while a second guide 1142 is attached to the exterior of the lower cuff 1130. The tension member 1128 is routed from the lower reel based device 1122 to the first guide 1140 and is routed therefrom to the second guide 1142. The tension member 1128 is routed from the second guide 1142 to the third guide 1144. The tension member 1128 commonly terminates at the third guide 1144, but in some instances may be routed back toward or to the lower reel based device 1122. The lower reel based device 1122 is operable to tension the lower cuff 1130 independently of the upper reel based device 1102, which allows the upper and lower cuffs of the ski boot to be independently and differentially tightened about the user's leg. The lower reel based device 1122 tensions the lower cuff by wrapping the lower panel 1114 more securely over the lower cuff as the tension member 1128 is tensioned.

Figure 19:
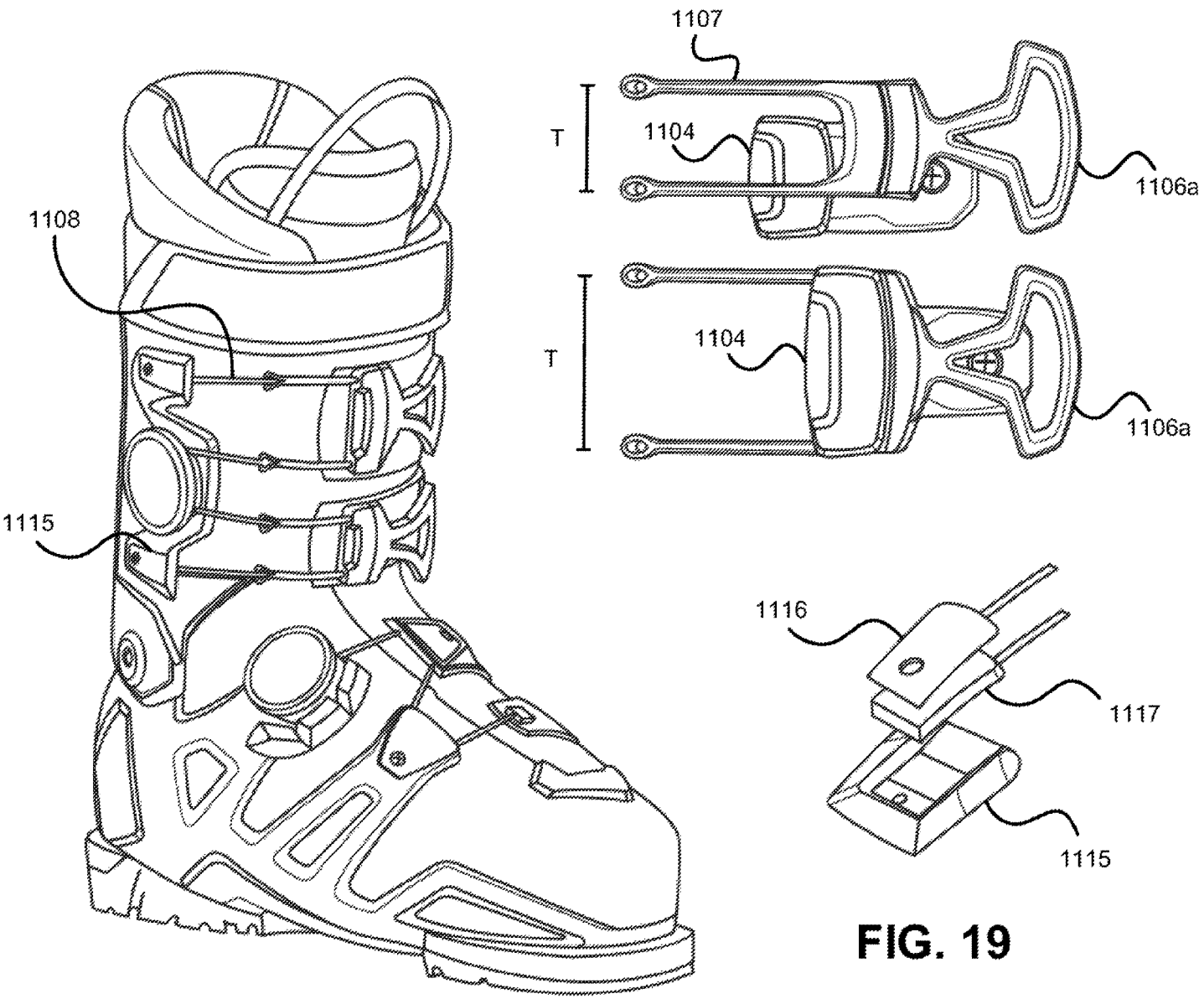
FIG. 19 illustrates a distal guide and different embodiments of a releasable guide.

FIG. 19 illustrates different embodiments of the releasable guide **1106*a* and also illustrates a distal guide that may be used to replace the tubing 1109 that routes the tension member 1108 around the upper reel based device 1102. The guides 1106*a* illustrated in FIG. 19 differ from those of FIGS. 15-18 in that the tab member is not a solid component. Rather, the tab member includes a large central opening that may be made of a flexible and grippable material, such as various rubber or polymer materials. The body of the guide 1106*a* may likewise be made of a flexible rubber or polymer material, although the body is commonly stiffer than the tab member. In addition, the guide 1106*a* includes extended lace ports 1107 that include a channel through which the tension member 1108 is inserted. The lace ports 1107 provide a sheath that shields the tension member 1108 from contact with external objects, which protects the tension member 1108 from accidental or unintended fraying, abrasion, or severing. The lace ports 1107** may be made of a relatively strong or durable material that is able to withstand contact and abrasion from nearby objects that are commonly encountered during skiing.

In other embodiments, the tension member 1108 may be configured to connect directly to the lace ports 1107 rather than being inserted through the lace ports. In such embodiments, the tension member 1108 may be terminated at the ends of the lace ports 1107 so that the tension member 1108 is not wrapped or positioned around the guide base 1104. The lace ports 1107 may be a flexible elastic like material that is able to stretch or flex as the guide **1106*a* is pulled away from the guide base 1104. The flexible or stretchable lace ports 1107 allow the guide 1106*a* to compensate for differences in the tension exerted on an upper and lower portion of the guide 1106*a*. The tension member 1108 may be attached to the ends of the lace ports 1107 by forming a knot in the tension member 1108 and attaching the knot to the ends of the lace ports 1107. FIG. 19 further illustrates that the guides 1106*a*** may have different widths T to accommodate different sized ski boots and/or for any other reason.

The distal guides may be used in place of the tubing 1109 that routes the tension member 1108. In such embodiments, the tension member 1108 is typically designed to terminate at the distal guides. The distal guides may be configured to allow the tension member 1108 to be detached from the guide. For example, the distal guides may include a base member 1115 and a removable cap 1116 that attaches to the base member 1115. The tension member 1108 may be attached to a middle pad 1117 that is designed to be positioned between the base member 1115 and the cap 1116. The cap 1116 may be fastened to the base member 1115 with the middle pad 1117 sandwiched between these components. If the user desires to remove the tension member 1108, such as for replacement and/or inspection, the user need simply remove the cap 1116 and the middle pad 1117 from the base member 1115. The cap 1116 may be fastened to the base member 1115 via a mechanical fasteners, adhesive bond, and/or using any other known coupling technique.

Figure 20:
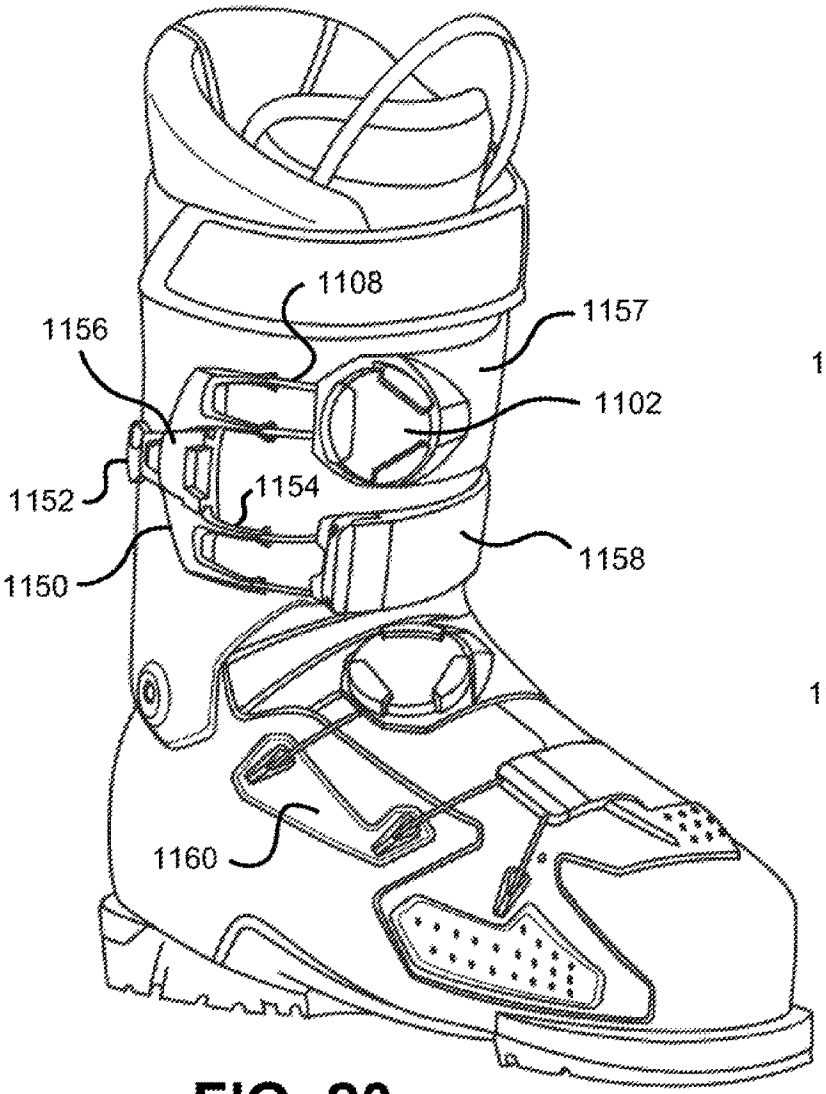
FIG. 20 illustrates another embodiment of a guide that is attached to a ski boot and operationally coupled with a tension member.

FIG. 20 illustrates another embodiment of a guide 1150 that is attached to the ski boot and operationally coupled with the tension member 1108. The guide 1150 is a single guide component that is designed to replace multiple guides, such as the pair of guides 1106 in FIGS. 15-18. The guide 1150 includes four openings through which the tension member 1108 is inserted and includes multiple channels through which the tension member is inserted and routed. Specifically, the guide 1150 includes an elongate channel that routes the tension member 1108 from the upper reel based device 1102 to a lower-most path of the tension member about the upper cuff. The guide 1150 also includes a middle channel that routes the tension member 1108 between middle paths about the upper cuff. The elongate channel is separate from the middle channel. The guide 1150 is designed to releasably couple with a guide base 1156 that is attached to the upper cuff and the guide 1150 includes a central tab 1152 that is configured to allow the user to grip and pull on the guide 1150 as previously described. The guide base 1156 is typically fixed or anchored to the upper cuff via a mechanical fastener, such as a rivet or screw, or via molding the guide base 1156 into the material of the upper cuff. The use of the single guide 1150 allows a user to easily interact with a single component in loosening or initially fitting the upper cuff of the ski boot about the leg, rather than requiring the user to interact with and loosen separate guides for the upper cuff. In some embodiments, the guide 1150 includes a magnet and the guide base 1156 includes an oppositely polarized magnet. The two magnets assist in placement of the guide 1150 within the guide base 1156.

In the illustrated embodiment, the upper reel based device 1102 is positioned on an upper end of the lace path rather than being disposed centrally between the tension member 1108. The tension member 1128 in the lower cuff is also partially routed under the lower cuff via tubing 1160 or a guide that is positioned under the lower cuff.

Figure 21:
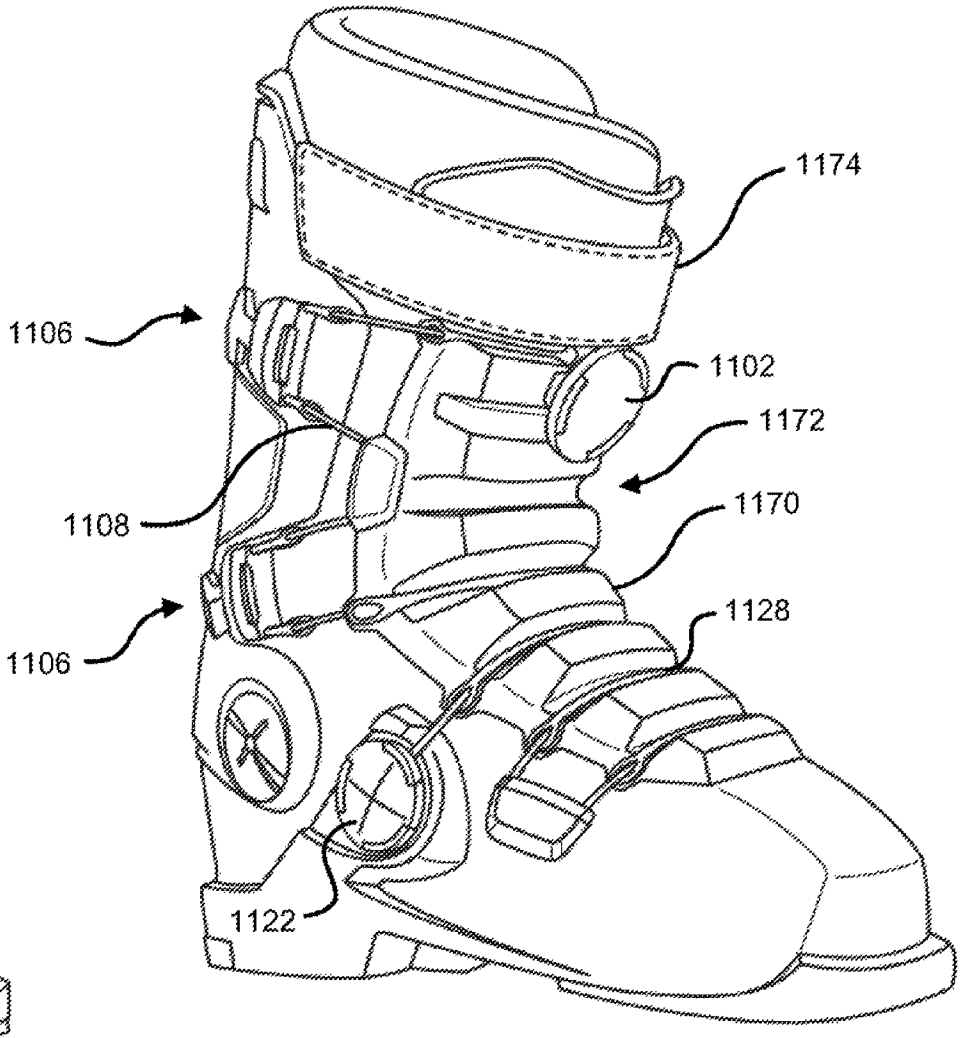
FIG. 21 illustrates another embodiment of a ski boot that includes a reel based device.

FIG. 21 illustrates another embodiment of a ski boot that includes a reel based device. The ski boot includes a front panel 1170 that is removable from a main body of the ski boot in order to allow the user to easily position their leg within the ski boot. The front panel 1170 is also removable to allow the user to customize the performance of the ski boot. For example, the user may remove the front panel 1170 and replace it with a front panel that is more rigid or more flexible in order to provide a desired level of flexibility and performance.

The reel based device, or reel based devices, is cooperatively designed to allow the front panel 1170 to be removed from the ski boot. For example, the upper reel based device 1102 may be secured to a top end of the front panel 1170 or may be positioned within a hole or aperture within the front panel 1170. The upper tension member 1108 is routed about the upper cuff and the front panel 1170 via guides 1106 that are detachable from a guide base 1104 that is attached to the upper cuff as previously described. The tension member 1108 is also routed within grooves 1172 or slots that are positioned along the front panel 1170. In some embodiments, the tubing or tension member channels or ports may be formed within the grooves or attached or secured within the grooves. The tubing, channels, or ports may cover and conceal the tension member to protect the tension member 1108 from contact with external objects that may abrade, wear, or sever the tension member 1108. Detaching the guides 1106 from the guide bases 1104 allows the front panel 1170 to be detached from the upper cuff of the ski boot. Since the upper reel based device 1102 is typically coupled with the front panel 1170, detaching the guides 1106 from the guide bases 1104 allows the front panel 1170 to be removed from the upper cuff.

The front panel 1170 may likewise be detached from the lower cuff of the ski boot. For example, the lower tension member 1128 may similarly be routed via guides 1106 that are detachable from a corresponding guide base 1104 (not shown). In other embodiments, the tension member 1128 may be loosened sufficiently to allow the tension member 1128 to be removed from the front panel 1170. The lower reel based device 1122 may likewise be attached to the front panel 1170 or positioned within a hole or aperture within the front panel 1170 to enable the front panel to be removed from the lower cuff.

The front panel 1170 may be removed for inspection, replacement, and/or for any other reason. The ski boot may include one or more straps that aid in maintaining a desired tightness of the ski boot's upper cuff about a user's foot. For example, FIG. 21 illustrates an upper strap 1174 that encircles the ski boot's upper cuff and that is adjustable to tighten the ski boot about the user's leg. The other embodiments illustrated herein, and in particular FIGS. 15-20, may likewise include an upper strap 1174 for similar reasons.

Figure 22:
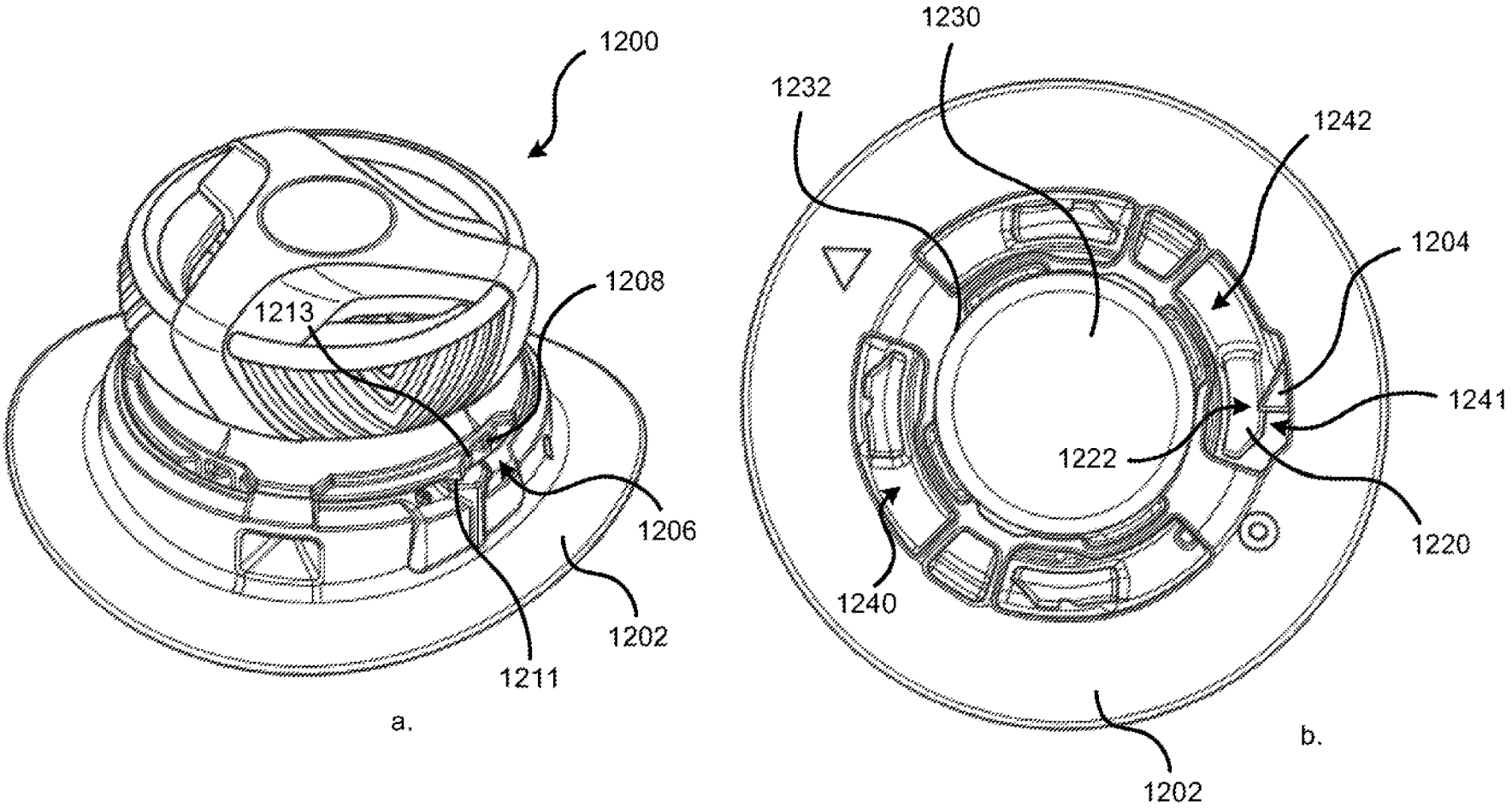
FIGS. 22-23 illustrate a reel based closure device that is designed to be releasable from a base member attached to an article, such as a ski boot.
Figure 23:
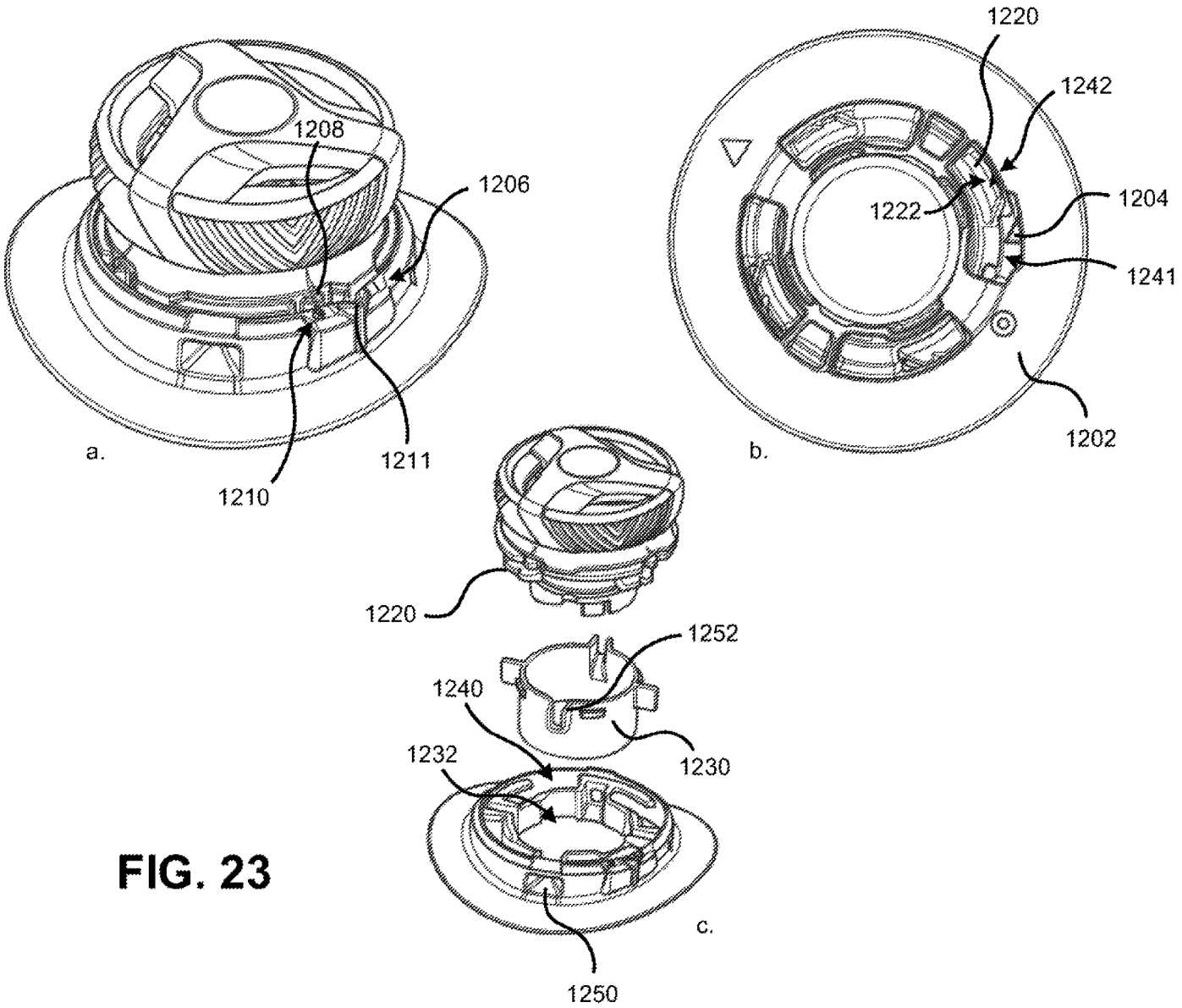

FIGS. 22 and 23 illustrate a reel based device 1200 that is designed to be releasable from a base member 1202 that is attached to an article, such as a shoe, ski boot, article of clothing, or any other article. In some embodiments, the reel based device 1200 couples with a cylindrical bottom member 1230 that is designed to fit within a corresponding sized and shaped cylindrical opening 1232 of the base member 1202. Once the cylindrical bottom member 1230 is attached to the base member 1202, the reel based device 1200 may be coupled with the base member 1202 and cylindrical bottom member 1230. In other embodiments, the cylindrical bottom member 1230 may be integrated into the base member so that the two components are combined in a single base member component. The reel based device 1200 also includes one or more coupling bosses or projections 1220 that are positioned radially outward from the cylindrical bottom member 1230 and that extend axially downward from a bottom end of the reel based device 1200. The base member 1202 includes one or more circumferentially arranged and positioned slots 1240 that are positioned between the cylindrical opening 1232 and a cylindrical exterior wall of the base member 1202. The circumferentially arranged slots 1240 are configured so that the coupling bosses 1220 are positioned within the slots 1240 when the reel based device 1200 is inserted within the cylindrical opening 1232 of the base member 1202. The circumferentially arranged slots 1240 are designed so that the coupling bosses 1220 are initially positioned within a first space 1242 of the slots 1240 when the reel based device 1200 is inserted within the cylindrical opening 1232. The positioning of the coupling boss 1220 within the first space 1242 of a slot 1240 is shown in image b of FIG. 23.

To attach and secure the reel based device 1200 to the base member 1202, the base member 1202 is designed so that the reel based device 1200 may be partially rotated (typically counterclockwise) relative to the base member 1202. Rotation of the reel based device 1200 relative to the base member 1202 causes the coupling boss 1220 to rotate from the first space 1242 into a second space 1241 of the slots 1240. The position of the coupling boss 1220 within the second space 1241 of the slot 1240 is shown in image b of FIG. 22. An upper portion of the slot 1240 narrows or is enclosed so that as the coupling boss 1220 rotates into the second space 1241, the coupling boss 1220 is positioned under the narrowed or enclosed slot and is not able to be axially extracted from the base member 1202, under normal loading conditions, due to interference between the coupling boss 1220 and the upper portion of the slot 1240.

As shown in image b of FIG. 22, the slot 1240 includes a radially inward projecting tooth 1204 that is designed to engage with a recess 1222 formed in the coupling boss 1220. The tooth 1204 is formed on or otherwise attached to the exterior wall of the base member 1202 and engagement of the tooth 1204 and the recess 1222 prevents the reel based device 1200 from being counter rotated (typically clockwise) relative to the base member 1202. In this manner, the tooth 1204 and recess 1222 lock or maintain the coupling boss 1220 within the second space 1241 of the slot 1240, which locks or maintains the reel based device 1200 within the base member 1202.

To uncouple the reel based device 1200 from the base member 1202, a tool, such as a screwdriver, is used to decouple the tooth 1204 from the recess 1222 of the coupling boss 1220. Specifically, as shown in image a of FIG. 22, when the reel based device 1200 is coupled with the base member 1202, an indicator 1208 of the reel based device 1200 is aligned with a corresponding indicator 1206 of the base member 1202. The alignment of the two indicators, 1208 and 1206, visually identifies that the reel based device 1200 is locked or secured about the base member 1202. The visual indicators, 1208 and 1206, may be physical indicators (e.g., arrows, protrusions, etc.) that are formed on the respective components or may be indicia (e.g., color bands, grooves, cuts, etc.) that is positioned on the reel based device 1200 and base member 1202.

With the indicators, 1208 and 1206, aligned, the tool (e.g., screwdriver) may be inserted within a recess or groove 1211 on the base member 1202 and within a corresponding recess or groove 1213 on the reel based device 1200. The grooves, 1211 and 1213, are specifically designed for use with a flat head screwdriver in which opposing ends of the screwdriver's head are positioned within each groove. The grooves, 1211 and 1213, are circumferentially offset slightly, which results in the head of the screwdriver being angled in relation to a circumference of the base member's exterior wall. Rotation of the screwdriver (typically counterclockwise) results in the screwdriver's head transitioning from the angled orientation relative to the circumference of the base member's exterior wall, to a position in which the screwdriver's head is diametrically aligned with the circumference of the base member's exterior wall, and further to a position in which the screwdriver's head is again angled relative to the circumference of the base member's exterior wall, but in which the screwdriver's head faces in an opposite direction. The movement of the screwdriver's head in relation to the base member 1202 and reel based device 1200 imparts a lever force on the exterior wall of the base member 1202, which causes the exterior wall in the immediate vicinity of the screwdriver to flex, move, or distort slightly radially outward. The slight radially outward flexing, moving, or distorting of the exterior wall causes the tooth 1204 to move out of the recess 1222 of the coupling boss 1220, which unlocks the coupling boss from the second space 1241 of the slot 1240. Rotation of the screwdriver further causes the reel based device 1200 to counter rotate relative to the base member 1202, which causes the coupling boss 1220 to rotate back into the first space 1242 of the slot 1240 as illustrated in image b of FIG. 23. With the coupling boss 1220 positioned in the first space 1242 of the slot 1240, the reel based device 1200 may be axially extracted from the cylindrical opening 1232 of the base member 1202 as shown in image c of FIG. 23.

As shown in image a of FIG. 23, after the reel based device 1200 is counter rotated relative to the base member 1202, the indicator 1208 of the reel based device 1200 is no longer aligned with the indicator 1206 of the base member 1202. Rather, the indicator 1208 of the reel based device 1200 is now aligned with a second indicator 1210 of the base member 1202. Alignment of the reel based device's indicator 1208 and the second indicator 1210 of the base member visually indicates that the reel based device 1200 is in a position that enables extraction of the reel based device 1200 from the base member 1202.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A ski boot comprising:

a rigid exterior shell comprising:

a lower shell that is configured to couple with a ski binding, the lower shell being configured to accommodate a foot, the lower shell including a lower panel that extends from a first side of the lower shell and at least partially over and atop an upper portion of the lower shell toward a second side of the lower shell;

an upper cuff that is pivotally coupled with the lower shell, the upper cuff being configured to accommodate a lower leg;

a first tightening system coupled with the second side of the lower shell, the first tightening system including:

a first reel based closure device;

a first tension member operably coupled with the first reel based closure device so that an operation of the first reel based closure device effects tightening of the first tension member; and a plurality of first guide members that are positioned about the lower shell to route or direct the first tension member along a path about the lower shell; and a second tightening system coupled with the upper cuff, the second tightening system including:

a second reel based closure device;

a second tension member operably coupled with the second reel based closure device so that an operation of the second reel based closure device effects tightening of the second tension member; and a plurality of second guide members that are positioned about the upper cuff to route or direct the second tension member along a path about the upper cuff, wherein the first tightening system and the second tightening system are operable independently of each other so as to independently and differentially tightening the lower shell and the upper cuff;

wherein the second reel based closure device is centrally positioned between a pair of guide members of the plurality of second guide members;

wherein one or more guide members of the plurality of first guide members are attached to the lower panel such that tightening of the first tension member wraps the lower panel more securely over the upper portion of the lower shell; and wherein at least one of the first reel based closure device or the second reel based closure device is releasable from a base member attached to the lower shell or upper cuff to enable detachment of the first reel based closure device or the second reel based closure device from the ski boot.

2. The ski boot of claim 1, wherein the plurality of first guide members or the plurality of second guide members includes a guide member that allows the first tension member or the second tension member to be uncoupled from the lower shell or upper cuff to enable rapid loosening of a tension in the first tension member or the second tension member.

3. The ski boot of claim 2, wherein the guide member includes an open channel within which the first tension member or the second tension member is positionable, the open channel being configured so the first tension member or the second tension member is removable from the open channel to uncouple the first tension member or the second tension member from the lower shell or upper cuff.

4. The ski boot of claim 2, wherein the guide member includes:

a base member that is fixedly secured to the lower shell or upper cuff, and a guide body that is removably attachable to the base member to couple the guide body with the lower shell or upper cuff, the guide body having a channel through which the first tension member or second tension member is slidably positioned.

5. The ski boot of claim 4, wherein a distal end of the guide body has a shape that corresponds to a shape of a channel of the base member, which enables mating engagement of the distal end of the guide body within the base member's channel.

6. The ski boot of claim 4, wherein the guide body includes a strap or handle that is graspable by a user to facilitate in detaching the guide body from the base member.

7. The ski boot of claim 4, wherein each guide member of the pair of guide members has a configuration of the guide member of claim 4.

8. The ski boot of claim 1, wherein the first reel based closure device is positioned on the second side of the lower shell.

9. The ski boot of claim 1, wherein at least a portion of the first tension member or the second tension member is routed under the lower shell or upper cuff.

10. The ski boot of claim 1, wherein a first portion of the second tension member is routed along the path about the upper cuff on a first side of the second reel based closure device, and wherein a second portion of the second tension member is routed around a second side of the second reel based closure device so that the second reel based closure device is enclosed or surrounded by the second tension member.

11. The ski boot of claim 1, wherein an upper portion of the second tension member exits the second reel based closure device and immediately traverses to an upper guide of the pair of guide members, and wherein a lower portion of the second tension member exits the second reel based closure device and immediately traverses to a lower guide of the pair of guide members.

12. The ski boot of claim 1, wherein a first guide member of the pair of guide members is uncouplable from the upper cuff and a second guide member of the pair of guide members is fixedly secured or attached to the upper cuff.

13. A method of making a ski boot, the method comprising:

providing a ski boot comprising:

a lower shell that is configured to couple with a ski binding, the lower shell being configured to accommodate a user's foot, the lower shell including a lower panel that extends from a first side of the lower shell and at least partially over an upper portion of the lower shell toward a second side of the lower shell; and an upper cuff that is pivotally coupled with the lower shell, the upper cuff being configured to accommodate a user's lower leg;

coupling a first tightening system with the second side of the lower shell, the first tightening system including:

a first reel based closure device;

a first tension member operably coupled with the first reel based closure device so that an operation of the first reel based closure device effects tightening of the first tension member; and a plurality of first guide members that are positioned about the lower shell to route or direct the first tension member along a path about the lower shell; and attaching one or more guide members of the plurality of first guide members to the lower panel;

coupling a second tightening system with the upper cuff, the second tightening system including:

a second reel based closure device;

a second tension member operably coupled with the second reel based closure device so that an operation of the second reel based closure device effects tightening of the second tension member; and a plurality of second guide members that are positioned about the upper cuff to route or direct the second tension member along a path about the upper cuff;

wherein the first tightening system and the second tightening system are operable independently of each other so as to independently and differentially tightening the lower shell and the upper cuff;

wherein the second reel based closure device is centrally positioned between a pair of guide members of the plurality of second guide members; and wherein at least one of the first reel based closure device or the second reel based closure device is releasable from a base member attached to the lower shell or upper cuff to enable detachment of the first reel based closure device or the second reel based closure device from the ski boot.

14. The method of claim 13, wherein the plurality of first guide members or the plurality of second guide members includes a guide member that allows the first tension member or the second tension member to be uncoupled from the lower shell or upper cuff to enable rapid loosening of a tension in the first tension member or the second tension member.

15. The method of claim 13, wherein at least a portion of the first tension member or the second tension member is routed under the lower shell or upper cuff.

16. A ski boot comprising:

a rigid exterior shell comprising:

a lower shell that is configured to couple with a ski binding, the lower shell being configured to accommodate a foot;

an upper cuff that is pivotally coupled with the lower shell, the upper cuff being configured to accommodate a lower leg;

a first tightening system coupled with the lower shell, the first tightening system including:

a first reel based closure device;

a first tension member operably coupled with the first reel based closure device; and a plurality of first guide members that are positioned about the lower shell to route or direct the first tension member along a path about the lower shell; and a second tightening system coupled with the upper cuff, the second tightening system including:

a second reel based closure device;

a second tension member operably coupled with the second reel based closure device; and a plurality of second guide members that are positioned about the upper cuff to route or direct the second tension member along a path about the upper cuff, wherein the first tightening system and the second tightening system are operable independently of each other so as to independently and differentially tightening the lower shell and the upper cuff; and wherein the second reel based closure device is centrally positioned between a pair of guide members of the plurality of second guide members.

17. The ski boot of claim 16, wherein an upper portion of the second tension member exits the second reel based closure device and immediately traverses to an upper guide of the pair of guide members, and wherein a lower portion of the second tension member exits the second reel based closure device and immediately traverses to a lower guide of the pair of guide members.

18. The ski boot of claim 16, wherein a first guide member of the pair of guide members is uncouplable from the upper cuff and a second guide member of the pair of guide members is fixedly secured or attached to the upper cuff.

* * * * *